US009007407B2

(12) United States Patent
Yamada

(10) Patent No.: US 9,007,407 B2
(45) Date of Patent: Apr. 14, 2015

(54) CONTROLLER OF ELECTRO-OPTICAL DEVICE, CONTROL METHOD OF ELECTRO-OPTICAL DEVICE, ELECTRO-OPTICAL DEVICE, AND ELECTRONIC APPARATUS

(75) Inventor: Yusuke Yamada, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 337 days.

(21) Appl. No.: 13/461,399

(22) Filed: May 1, 2012

(65) Prior Publication Data

US 2012/0287175 A1 Nov. 15, 2012

Related U.S. Application Data

(60) Provisional application No. 61/484,424, filed on May 10, 2011.

(30) Foreign Application Priority Data

Jun. 14, 2011 (JP) ..... 2011-132463

(51) Int. Cl.
*G09G 5/10* (2006.01)
*G09G 3/20* (2006.01)
*G09G 3/34* (2006.01)

(52) U.S. Cl.
CPC ..... *G09G 3/2092* (2013.01); *G09G 3/2007* (2013.01); *G09G 3/344* (2013.01)

(58) Field of Classification Search
USPC ..... 345/690, 107, 214
See application file for complete search history.

(56) References Cited

U.S. PATENT DOCUMENTS

| | | | |
|---|---|---|---|
| 2006/0050361 | A1 | 3/2006 | Johnson |
| 2007/0139358 | A1 | 6/2007 | Sakamoto |
| 2007/0296690 | A1 | 12/2007 | Nagasaki |
| 2009/0256798 | A1 | 10/2009 | Low et al. |
| 2010/0231571 | A1 | 9/2010 | Tanabe |
| 2011/0001748 | A1 | 1/2011 | Rutman et al. |

FOREIGN PATENT DOCUMENTS

| | | |
|---|---|---|
| CN | 101840666 A | 9/2010 |
| JP | A-2009-251615 | 10/2009 |

OTHER PUBLICATIONS

Extended European Search Report dated Sep. 1, 2014 from European Patent Application No. 12782677.4.

*Primary Examiner* — Robin Mishler
(74) *Attorney, Agent, or Firm* — Oliff PLC

(57) ABSTRACT

When changing a pixel to white in the middle of a writing operation for writing the pixel in black, a new writing operation for writing the pixel in white is started. When changing a pixel to black in the middle of a writing operation for writing the pixel in white, a new writing operation for writing the pixel in black is started. In addition, when a difference between the number of times of application of a first voltage applied to change the pixel to white and the number of times of application of a second voltage applied to change the pixel to black is not a predetermined value at a predetermined timing, the first voltage or the second voltage is applied to the pixel until the difference becomes a predetermined value.

14 Claims, 20 Drawing Sheets

| | | GRADATION VALUE AFTER CHANGE | |
|---|---|---|---|
| | | 5 | 0 |
| GRADATION VALUE BEFORE CHANGE | 5 | 0 | 3 |
| | 4 | 1 | 2 |
| | 3 | 2 | 2 |
| | 2 | 3 | 1 |
| | 1 | 4 | 1 |
| | 0 | 5 | 0 |

GRADATION VALUE = 5

GRADATION VALUE = 4

GRADATION VALUE = 3

GRADATION VALUE = 2

GRADATION VALUE = 1

GRADATION VALUE = 0

TIME →

| | 1 | | 5 | | | | | 10 | | | | | 15 | | | | | 20 | | | | | 25 |
|---|---|---|---|---|---|---|---|---|---|---|---|---|---|---|---|---|---|---|---|---|---|---|---|
| BUFFER A(1,1) | 0 | 0 | 5 | 5 | 0 | 0 | 0 | 0 | 0 | 0 | 5 | 5 | 0 | 0 | 0 | 0 | 0 | 0 | 0 | 0 | 0 | 0 | 0 | 0 |
| PLANNED IMAGE STORAGE REGION E(1,1) | 0 | 0 | 5 | 5 | 0 | 0 | 0 | 0 | 0 | 0 | 5 | 5 | 5 | 5 | 5 | 5 | 5 | 5 | 5 | 0 | 0 | 0 | 0 | 0 | 0 |
| REMAINING NUMBER -OF-TIMES STORAGE REGION B(1,1) | 0 | 0 | 4 | 3 | 4 | 3 | 2 | 1 | 0 | 0 | 4 | 3 | 2 | 1 | 0 | 0 | 0 | 0 | 0 | 4 | 3 | 2 | 1 | 0 | 0 |
| NUMBER-OF-TIMES DIFFERENCE STORAGE REGION D(1,1) | 5 | 5 | 4 | 3 | 5 | 6 | 7 | 8 | 9 | 9 | 8 | 7 | 6 | 5 | 4 | 3 | 2 | 1 | 0 | 1 | 2 | 3 | 4 | 5 | 5 |
| POLARITY OF APPLIED VOLTAGE WITH RESPECT TO COMMON ELECTRODE LAYER | 0 | 0 | - | - | + | + | + | + | + | 0 | - | - | - | - | - | - | - | - | - | + | + | + | + | + | 0 |

CONTROLLER OF ELECTRO-OPTICAL DEVICE, CONTROL METHOD OF ELECTRO-OPTICAL DEVICE, ELECTRO-OPTICAL DEVICE, AND ELECTRONIC APPARATUS

BACKGROUND

1. Technical Field

The present invention relates to a controller of an electro-optical device, a control method of an electro-optical device, an electro-optical device, and an electronic apparatus.

2. Related Art

An electrophoretic display device using microcapsules is an example of a display device which displays an image. In an active matrix type display device, a driving circuit for driving a microcapsule is provided at each of the intersections of a plurality of row electrodes extending in a row direction and a plurality of column electrodes extending in a column direction. When a voltage is applied to the row electrode and the column electrode, a potential difference is generated between an electrode provided in the driving circuit and an electrode facing the electrode in the driving circuit with a microcapsule interposed therebetween. When the potential difference is generated between the electrodes facing each other with a microcapsule interposed therebetween, white and black particles in the microcapsule move according to the electric field caused by the potential difference. Since the distribution of white and black particles in each microcapsule changes, the optical reflection property changes to display an image.

Meanwhile, in the electrophoretic display device, image rewriting when changing a display by the active matrix method may be performed over a plurality of frames. However, if the rewriting starts on the full screen when performing the image rewriting over a plurality of frames, new writing cannot be performed until the writing ends. Accordingly, when adding or removing an image, the next writing starts after the end of the image writing. Since this takes time, there is a problem in terms of operability.

In order to solve such a problem, a method of performing the writing by performing pipeline processing in units of a partial region has been proposed (refer to JP-A-2009-251615). According to the method disclosed in JP-A-2009-251615, an image is written in two partial regions on the screen, which do not overlap each other, at different timings. Accordingly, even if the writing of a partial region where writing has started first is not completed, the writing of the other partial region where writing starts later can be started. As a result, it is possible to improve the display speed compared with that when this method is not adopted.

In the method disclosed in JP-A-2009-251615, however, if the partial regions overlap partly, the writing of the partial region where writing starts later should wait until the writing of the partial region where writing has started first ends. For this reason, it takes time until the display is completed.

SUMMARY

An advantage of some aspects of the invention is to improve the perceived display speed of an electro-optical device which needs to perform voltage application multiple times in order to change the gray level of a pixel.

An aspect of the invention is directed to a controller of an electro-optical device which includes a display unit with a plurality of pixels and in which a writing operation of changing the pixel from first gray level to second gray level and a writing operation of changing the pixel from the second gray level to the first gray level are performed by an operation of applying a voltage to the pixel multiple times. The controller of an electro-optical device includes: a number-of-times difference calculating section that calculates a difference between the number of times of application of a first voltage, which is applied to change the pixel to the first gray level, and the number of times of application of a second voltage, which is applied to change the pixel to the second gray level; and a voltage control section that applies the first voltage or the second voltage to the pixel until the difference becomes a predetermined value when the difference regarding the pixel is not the predetermined value at a predetermined timing and that, when changing a gray level of the pixel, starts a new operation of applying a voltage to the pixel multiple times even in the middle of the writing operation.

In the controller of an electro-optical device according to the aspect of the invention, it is possible to improve the perceived display speed of an electro-optical device which needs to perform voltage application multiple times in order to change the gray level of a pixel.

In the controller described above, when the pixel has the first gray level and the difference regarding the pixel is not the predetermined value after the writing operation ends, the voltage control section may apply the first voltage to the pixel until the difference becomes the predetermined value.

According to this configuration, when there is a difference between the number of times of application of the first voltage and the number of times of application of the second voltage after the writing operation ends, the first voltage is applied until the difference of the number of times of application becomes a predetermined value. In this case, since the difference between the number of times of application of the first voltage and the number of times of application of the second voltage does not become large, deterioration of the pixel can be suppressed.

In the controller described above, when the pixel has the second gray level and the difference regarding the pixel is not the predetermined value after the writing operation ends, the voltage control section may apply the second voltage to the pixel until the difference becomes the predetermined value.

According to this configuration, when there is a difference between the number of times of application of the first voltage and the number of times of application of the second voltage after the writing operation ends, the second voltage is applied until the difference of the number of times of application becomes a predetermined value. In this case, since the difference between the number of times of application of the first voltage and the number of times of application of the second voltage does not become large, deterioration of the pixel can be suppressed.

In the controller described above, when an absolute value of the difference is equal to or larger than a threshold value when a writing operation of setting the pixel to the first gray level starts in the middle of a writing operation of setting the pixel to the second gray level, the voltage control section may apply the second voltage until the difference becomes the predetermined value and then start application of the first voltage.

According to this configuration, a new writing operation is started after the difference between the number of times of application of the first voltage and the number of times of application of the second voltage is set to the predetermined value. Therefore, even if the new writing operation is performed, the difference between the number of times of application of the first voltage and the number of times of application of the second voltage does not become large. As a result, deterioration of the pixel can be suppressed.

In the controller described above, when an absolute value of the difference is equal to or larger than a threshold value when a writing operation of setting the pixel to the second gray level starts in the middle of a writing operation of setting the pixel to the first gray level, the voltage control section may apply the first voltage until the difference becomes the predetermined value and then start application of the second voltage.

According to this configuration, a new writing operation is started after the difference between the number of times of application of the first voltage and the number of times of application of the second voltage is set to the predetermined value. Therefore, even if the new writing operation is performed, the difference between the number of times of application of the first voltage and the number of times of application of the second voltage does not become large. As a result, deterioration of the pixel can be suppressed.

The controller described above may further include an application number-of-times determining section that, when changing the gray level of the pixel, determines the number of times of application on the basis of the gray level of the pixel before the change, the gray level of the pixel after the change, and a table in which the number of times of application of a voltage for gray level change from the gray level before the change to the gray level after the change matches the gray level before the change and the gray level after the change.

According to this configuration, since the appropriate number of times of voltage application is set on the basis of the gray level of the pixel before gray level change and the gray level of the pixel after gray level change, it is possible to increase the pixel rewriting speed compared with a configuration in which the number of times of voltage application is made to be fixed.

In the controller described above, the number of times of application of the first voltage applied to change the pixel to the first gray level may be different from the number of times of application of the second voltage applied to change the pixel to the second gray level.

According to this configuration, compared with a configuration in which the number of times of voltage application is the same in the case of changing the pixel to the first gray level and the case of changing the pixel to the second gray level, the speed of change to either one of the gray levels can be increased.

Another aspect of the invention is directed to a control method of an electro-optical device which includes a display unit with a plurality of pixels and in which a writing operation of changing the pixel from first gray level to second gray level and a writing operation of changing the pixel from the second gray level to the first gray level are performed by an operation of applying a voltage to the pixel multiple times. The control method of an electro-optical device includes: calculating a difference between the number of times of application of a first voltage, which is applied to change the pixel to the first gray level, and the number of times of application of a second voltage, which is applied to change the pixel to the second gray level; and applying the first voltage or the second voltage to the pixel until the difference becomes a predetermined value when the difference regarding the pixel is not the predetermined value at a predetermined timing and starting a new operation of applying a voltage to the pixel multiple times even in the middle of the writing operation when changing a gray level of the pixel.

In the control method of an electro-optical device according to the aspect of the invention, it is possible to improve the perceived display speed of an electro-optical device which needs to perform voltage application multiple times in order to change the gray level of a pixel.

Still another aspect of the invention is directed to an electro-optical device which includes a display unit with a plurality of pixels and in which a writing operation of changing the pixel from first gray level to second gray level and a writing operation of changing the pixel from the second gray level to the first gray level are performed by an operation of applying a voltage to the pixel multiple times, the electro-optical device comprising: a number-of-times difference calculating section that calculates a difference between the number of times of application of a first voltage, which is applied to change the pixel to the first gray level, and the number of times of application of a second voltage, which is applied to change the pixel to the second gray level; and a voltage control section that applies the first voltage or the second voltage to the pixel until the difference becomes a predetermined value when the difference regarding the pixel is not the predetermined value at a predetermined timing and that, when changing a gray level of the pixel, starts a new operation of applying a voltage to the pixel multiple times even in the middle of the writing operation.

In the electro-optical device according to the aspect of the invention, it is possible to improve the perceived display speed of an electro-optical device which needs to perform voltage application multiple times in order to change the gray level of a pixel.

The invention may be concepted as an electronic apparatus including the electro-optical device described above, as well as the electro-optical device.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Configuration of a First Embodiment

Figure 1:
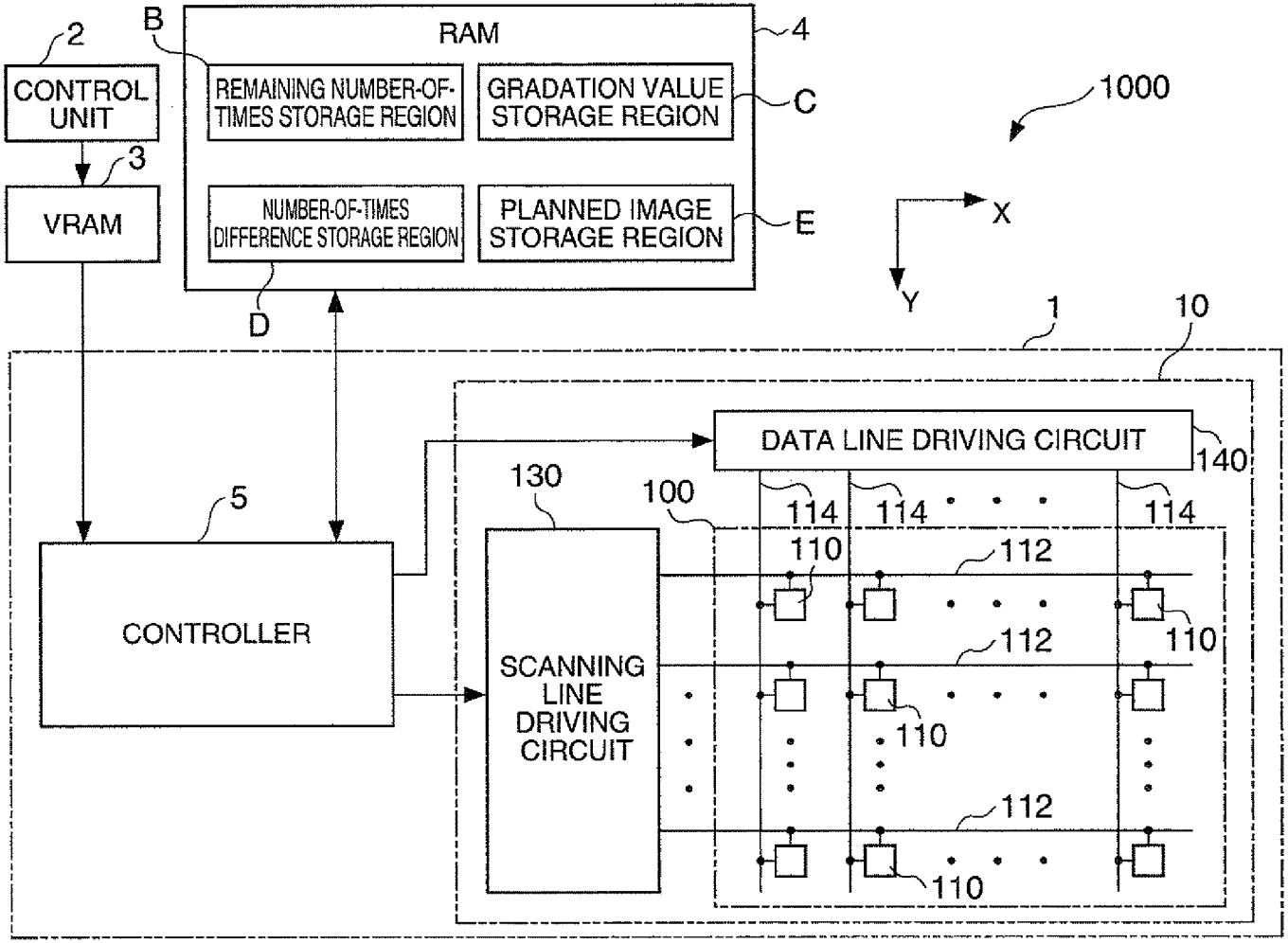
FIG. 1 is a view showing the hardware configuration of a display device and an electro-optical device.

FIG. 1 is a block diagram showing the hardware configuration of a display device 1000 according to an embodiment of the invention. The display device 1000 is a device which displays an image, and includes an electrophoretic electro-optical device 1, a control unit 2, a VRAM (Video Random Access Memory) 3, and a RAM 4 which is an example of a storage unit. In addition, the electro-optical device 1 includes a display unit 10 and a controller 5.

The control unit 2 is a microcomputer including a CPU (Central Processing Unit), a ROM (Read Only Memory), a RAM, and the like, and controls each unit of the display device 1000. In addition, the control unit 2 accesses the VRAM 3 to writes the image data, which shows an image displayed on a display area 100, into the VRAM 3.

The controller 5 supplies various signals for displaying an image in the display area 100 of the display unit 10 to a scanning line driving circuit 130 and a data line driving circuit 140 of the display unit 10. The controller 5 is equivalent to a control unit of the electro-optical device 1. In addition, all of the control unit 2 and the controller 5 may be defined as a controller of the electro-optical device 1. Alternatively, all of the control unit 2, the controller 5, the VRAM 3, and the RAM 4 may be defined as a controller of the electro-optical device 1.

The VRAM 3 is memory which stores the image data written by the control unit 2. The VRAM 3 has a storage region (buffer) for each of pixels 110 arrayed in m rows×n columns, which will be described later. The image data includes pixel data showing the gray level of each pixel 110. The pixel data showing the gray level of one pixel 110 is stored in one storage region, which corresponds to the pixel 110, in the VRAM 3. The pixel data written in the VRAM 3 is read by the controller 5.

The RAM 4 stores various kinds of data used in order to display an image on the display area 100. A remaining number-of-times storage region B, a gray level value storage region C, a number-of-times difference storage region D, and a planned image storage region E are provided in the RAM 4. Details of each storage region will be described later.

In the display area 100, a plurality of scanning lines 112 are provided along the row (X) direction in FIG. 1, and a plurality of data lines 114 are provided along the column (Y) direction so as to be electrically insulated from the scanning lines 112. In addition, the pixel 110 is provided corresponding to the intersection between each scanning line 112 and each data line 114. Assuming for the sake of convenience that the number of rows of the scanning lines 112 is "m" and the number of columns of the data lines 114 is "n", the pixels 110 are arrayed in a matrix (m rows×n columns) to form the display area 100.

Figure 2:
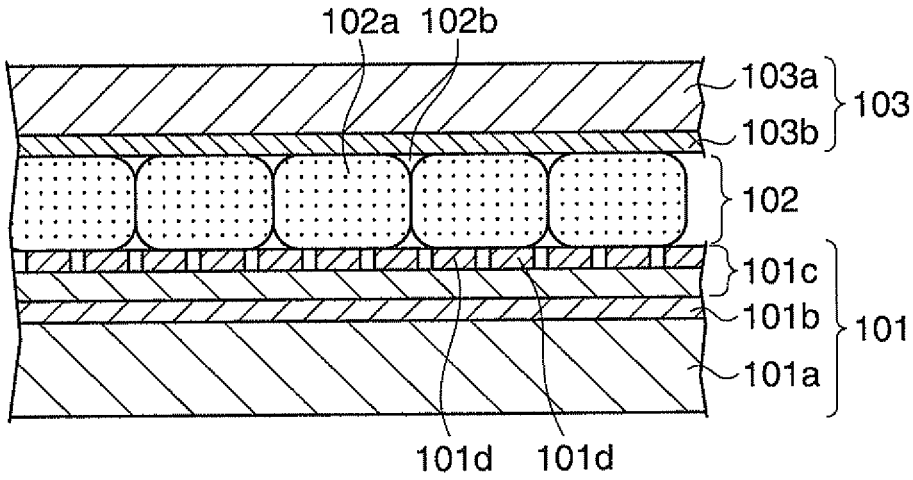
FIG. 2 is a view showing the cross section of a display area.

FIG. 2 is a view showing the cross section of the display area 100. The display area 100 is largely divided as shown in FIG. 2, and is formed by a first substrate 101, an electrophoretic layer 102, and a second substrate 103. The first substrate 101 is a substrate in which a circuit layer is formed on an insulating and flexible substrate 101*a*. In the present embodiment, the substrate 101*a* is formed of polycarbonate. In addition, a resin material which is light, flexible, has elasticity and is insulative may also be used for the substrate 101*a* without being limited to polycarbonate. In addition, the substrate 101*a* may be formed of glass which does not have flexibility. An adhesive layer 101*b* is provided on the surface of the substrate 101*a*, and a circuit layer 101*c* is laminated on the surface of the adhesive layer 101*b*. The circuit layer 101*c* has a plurality of scanning lines 112 arrayed in the row direction and a plurality of data lines 114 arrayed in the column direction.

In addition, the circuit layer 101*c* has a pixel electrode 101*d* corresponding to each of the intersections between the scanning lines 112 and the data lines 114.

The electrophoretic layer 102 is formed by a binder 102*b* and a plurality of microcapsules 102*a* fixed by the binder 102*b*, and is formed on the pixel electrodes 101*d*. In addition, an adhesive layer formed by an adhesive may be provided between the microcapsules 102*a* and the pixel electrodes 101*d*.

The binder 102*b* is not particularly limited as long as it has a good affinity with the microcapsules 102*a*, excellent adhesiveness to electrodes, and insulation properties. A dispersion medium and electrophoretic particles are contained in the microcapsule 102*a*. As materials which form the microcapsules 102*a*, it is preferable to use flexible materials, such as gum Arabic and gelatin based compounds and urethane based compounds.

As a dispersion medium, the following materials may be used: water; alcohol solvents (for example, methanol, ethanol, isopropanol, butanol, octanol and methyl cellosolve); esters (for example, ethyl acetate and butyl acetate); ketones (for example, acetone, methyl ethyl ketone, and methyl isobutyl ketone); aliphatic hydrocarbons (for example, pentane, hexane, and octane); alicyclic hydrocarbons (for example, cyclohexane and methylcyclohexane); aromatic hydrocarbons (for example, benzene, toluene, and benzenes having a long-chain alkyl group (xylene, hexyl benzene, heptyl benzene, octyl benzene, nonyl benzene, decyl benzene, undecyl benzene, dodecyl benzene, tridecyl benzene, and tetradecyl benzene)); halogenated hydrocarbons (for example, methylene chloride, chloroform, carbon tetrachloride, and 1,2-dichloroethane); and carboxylates. In addition, other various kinds of oils may be used as the dispersion medium. In addition, a single or a mixture of the above materials may be used as a dispersion medium, or surfactant or the like may be further mixed with a dispersion medium.

Electrophoretic particles are particles (polymer or colloid) which move in a dispersion medium by the electric field. In the present embodiment, white electrophoretic particles and black electrophoretic particles are contained in the microcapsule 102*a*. The black electrophoretic particle is a particle formed of a black pigment, such as aniline black or carbon black, for example. In the present embodiment, the black electrophoretic particle is positively charged. The white electrophoretic particle is a particle formed of a white pigment, such as a titanium dioxide or an aluminum oxide, for example. In the present embodiment, the white electrophoretic particle is negatively charged.

The second substrate 103 includes a film 103*a* and a transparent common electrode layer 103*b* (second electrode) formed on the bottom surface of the film 103*a*. The film 103*a* serves to seal and protect the electrophoretic layer 102, and is a polyethylene terephthalate film, for example. The film 103*a* is transparent and has an insulation property. The common electrode layer 103*b* is formed of a transparent conductive film, such as an indium tin oxide film (ITO film), for example.

Figure 3:
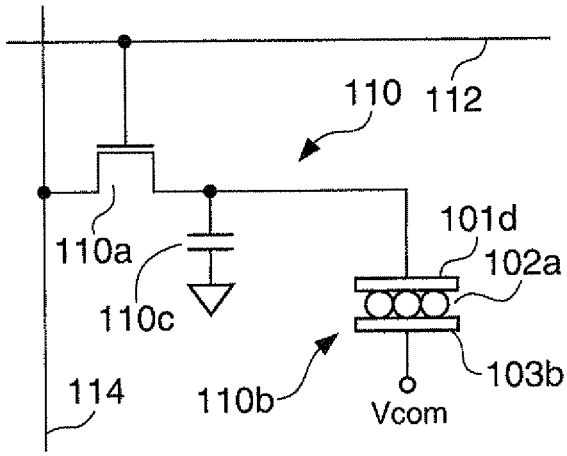
FIG. 3 is a view showing an equivalent circuit of a pixel.

FIG. 3 is a view showing an equivalent circuit of the pixel 110. Moreover, in the present embodiment, in order to distinguish the scanning lines 112, the scanning lines 112 shown in FIG. 1 may be called scanning lines on first, second, third, . . . , (m-1)-th, and m-th rows in order from the top. Similarly, in order to distinguish the data lines 114, the data lines 114 shown in FIG. 1 may be called data lines on first, second, third, . . . , (n-1)-th, and nth rows in order from the left.

FIG. 3 shows an equivalent circuit of the pixel 110 corresponding to the intersection between the scanning line 112 on the i-th row and the data line 114 on the j-th column. Since the pixels 110 corresponding to the intersections between other data lines 114 and other scanning lines 112 also have the same configuration shown in the drawing, an equivalent circuit of the pixel 110 corresponding to the intersection between the data line 114 on the i-th row and the scanning line 112 on the j-th column will be representatively described, and explanation regarding equivalent circuits of other pixels 110 will be omitted.

As shown in FIG. 3, each pixel 110 has an n channel type thin film transistor (hereinafter, abbreviated as a "TFT") 110*a*, a display element 110*b*, and an auxiliary capacitor 110*c*. In the pixel 110, a gate electrode of the TFT 110*a* is connected to the scanning line 112 on the i-th row, a source electrode of the TFT 110*a* is connected to the data line 114 on the j-th column, and a drain electrode of the TFT 110*a* is connected to a pixel electrode 101*d*, which is an end of the display element 110*b*, and an end of the auxiliary capacitor 110*c*. The auxiliary capacitor 110*c* has a configuration in which a dielectric layer is interposed between a pair of electrodes formed in the circuit layer 101*c*. The other electrode of the auxiliary capacitor 110*c* has a voltage common to all pixels. The pixel electrode 101*d* faces the common electrode layer 103*b*, and the electrophoretic layer 102 is interposed between the pixel electrode 101*d* and the common electrode layer 103*b*. Accordingly, when seen in the equivalent circuit, the display element 110*b* is a capacitor in which the electrophoretic layer 102 is interposed between the pixel electrode 101*d* and the common electrode layer 103*b*. In addition, the display element 110*b* holds (stores) a voltage between both the electrodes and performs display according to the direction of an electric field caused by the held voltage. Moreover, in the present embodiment, a common voltage Vcom is applied to the other end of the auxiliary capacitor 110*c* of each pixel 110 and the common electrode layer 103*b* by an external circuit (not shown).

Referring back to FIG. 1, the scanning line driving circuit 130 is connected to each scanning line 112 of the display area 100. Under the control of the controller 5, the scanning line driving circuit 130 selects the scanning lines 112 in order of first, second, . . . , m-th rows, and supplies a high-level (High) signal to the selected scanning line 112 and supplies a low-level (Low) signal to the other scanning lines 112 which are not selected.

The data line driving circuit 140 is connected to each data line 114 in the display area, and supplies a data signal to the data line 114 on each column according to the display content of the pixels 110 on one row which are connected to the selected scanning line 112.

A period until the selection of the scanning line 112 on the m-th row ends after the scanning line driving circuit 130 selects the scanning line 112 on the first row (hereinafter, referred to as a "frame period" or simply referred to as a "frame"), each scanning line 112 is selected once, and a data signal is supplied to each pixel 110 once in one frame.

When the scanning line 112 changes to the high level, the TFT 110*a* whose gate is connected to the scanning line 112 is turned on and accordingly, the pixel electrode 101*d* is connected to the data line 114. If a data signal is supplied to the data line 114 when the scanning line 112 is at a high level and, the data signal is applied to the pixel electrode 101*d* through the TFT 110*a* which is in the ON state. When the scanning line 112 changes to the low level, the TFT 110*a* is turned off. However, the voltage applied to the pixel electrode 101*d* by the data signal is accumulated in the auxiliary capacitor 110*c*, and electrophoretic particles move according to the potential difference (voltage) between the electric potential of the pixel electrode 101*d* and the electric potential of the common electrode layer 103*b*.

For example, when the voltage of the pixel electrode 101*d* is +15 V (second voltage) with the voltage Vcom of the common electrode layer 103*b* as a reference, white electrophoretic particles negatively charged move toward the pixel electrode 101*d* and black electrophoretic particles positively charged move toward the common electrode layer 103*b* As a result, the pixel 110 is displayed in black. In addition, when the voltage of the pixel electrode 101*d* is −15 V (first voltage) with the voltage Vcom of the common electrode layer 103*b* as a reference, black electrophoretic particles positively charged move toward the pixel electrode 101*d* and white electrophoretic particles negatively charged move toward the common electrode layer 103*b*. As a result, the pixel 110 is displayed in white. In addition, the voltage of the pixel electrode 101*d* is not limited to the above-described voltage, and may be a voltage other than +15 V or −15 V as long as it is a positive or negative voltage with the voltage Vcom of the common electrode layer 103*b* as a reference.

In the present embodiment, when changing the display state of each pixel 110 from white (low gray level) as first gray level to black (high gray level) as second gray level or from black to white, the display state is changed by a writing operation, which is to supply a data signal to the pixel 110 over a plurality of frames, instead of changing the display state by supplying a data signal to the pixel 110 in only one frame. This is because, when changing the display state from white to black, black electrophoretic particles do not move to the display side completely even if the potential difference is given to the electrophoretic particles in only one frame and accordingly, the display state does not become a full black display state. This is the same for white electrophoretic particles when changing the display state from black to white. Therefore, for example, a data signal for displaying the black on the pixel 110 is supplied to the pixel 110 over a plurality of frames when changing the display state of the pixel 110 from white to black, and a data signal for displaying the white on the pixel 110 is supplied to the pixel 110 over a plurality of frame when changing the display state of the pixel 110 from black to white.

Moreover, in the present embodiment, the pixel electrode 101*d* of a certain pixel 110 in one frame may be set as a positive electrode with a higher electric potential than the common electrode layer 103*b*, and the pixel electrode 101*d* of another pixel 110 in the same frame maybe set as a negative electrode with a lower electric potential than the common electrode layer 103*b*. That is, driving capable of selecting both electrodes of positive and negative electrodes with respect to the common electrode layer 103*b* in one frame (hereinafter, referred to as bipolar driving) is performed. More specifically, in one frame, the pixel electrode 101*d* of the pixel 110 which changes the gray level to the high gray level side (second gray level side) is set as a positive electrode, and the pixel electrode 101*d* of the pixel 110 which changes the gray level to the low gray level side (first gray level side) is set as a negative electrode. In addition, when black electrophoretic particles are negatively charged and white electrophoretic particles are positively charged, the pixel electrode 101*d* of the pixel 110 which changes the gray level to the high gray level side (second gray level side) may be set as a negative electrode, and the pixel electrode 101*d* of the pixel 110 which changes the gray level to the low gray level side (first gray level side) may be set as a positive electrode.

Next, the remaining number-of-times storage region B, the gray level value storage region C, the number-of-times difference storage region D, and the planned image storage region E will be described. FIGS. 4A to 4F are views showing some pixels 110 in the display area 100 and storage regions corresponding to the pixels 110. The storage region includes storage regions corresponds to each of the pixels 110 arrayed in m rows×n columns.

Figure 4A:
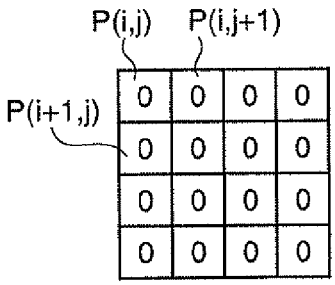
FIGS. 4A to 4F are views for explaining the configuration of a storage region.

FIG. 4A is a view showing the arrangement of the pixels 110. A pixel P(i, j) expresses one pixel 110 located on the i-th row and the j-th column. The subscript i indicates the row number of the pixel 110 arrayed in a matrix, and the subscript j indicates the column number.

Figure 4B:
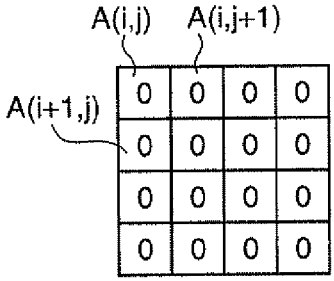

FIG. 4B is a view showing a buffer, which corresponds to each pixel shown in FIG. 4A, in the VRAM 3. For example, a buffer A(i, j) is a storage region corresponding to the pixel P(i, j). The pixel data indicating the gray level of the pixel P(i, j) is stored in the buffer A(i, j). In addition, the pixel data with a value "0" is written when displaying a pixel in black, and the pixel data with a value "5" is written when displaying a pixel in white.

Figure 4C:
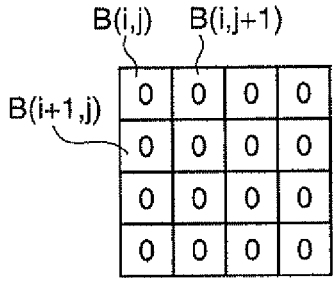

FIG. 4C is a view showing a storage region, which corresponds to each pixel shown in FIG. 4A, in the remaining number-of-times storage region B. For example, a remaining number-of-times storage region B(i, j) is a storage region corresponding to the pixel P(i, j). The value indicating the remaining number of times of application when applying a voltage to the pixel P(i, j) multiple times is stored in the remaining number-of-times storage region B(i, j).

Figure 4D:
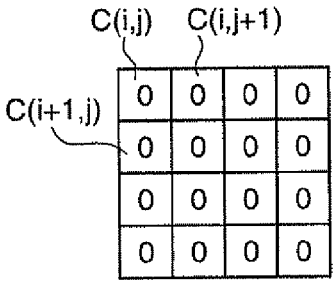

FIG. 4D is a view showing a storage region, which corresponds to each pixel shown in FIG. 4A, in the gray level value storage region C. For example, a gray level value storage region C(i, j) is a storage region corresponding to the pixel P(i, j). The value indicating the gray level of the pixel P(i, j) which has changed due to voltage application, is stored in the gray level value storage region C(i, j).

Figure 4E:
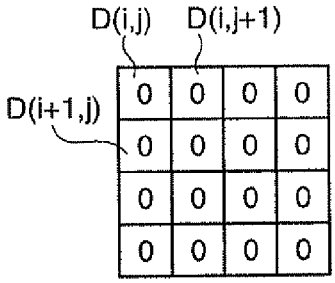

FIG. 4E is a view showing a storage region, which corresponds to each pixel shown in FIG. 4A, in the number-of-times difference storage region D. For example, the number-of-times difference storage region D(i, j) is a storage region corresponding to the pixel P(i, j). The value indicating the difference between the number of times of application of the positive voltage to the pixel P(i, j) and the number of times of application of the negative voltage to the pixel P(i, j) is stored in the number-of-times difference storage region D(i, j).

Figure 4F:
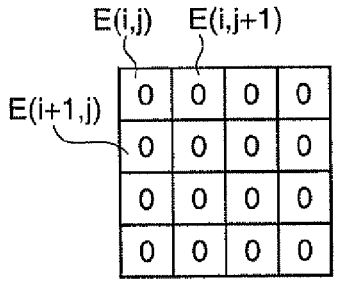

FIG. 4F is a view showing a storage region, which corresponds to each pixel shown in FIG. 4A, in the planned image storage region E. For example, a planned image storage region E(i, j) is a storage region corresponding to the pixel P(i, j). The pixel data of each pixel of an image to be displayed in the display area 100 is stored in the planned image storage region E(i, j).

Figure 5:
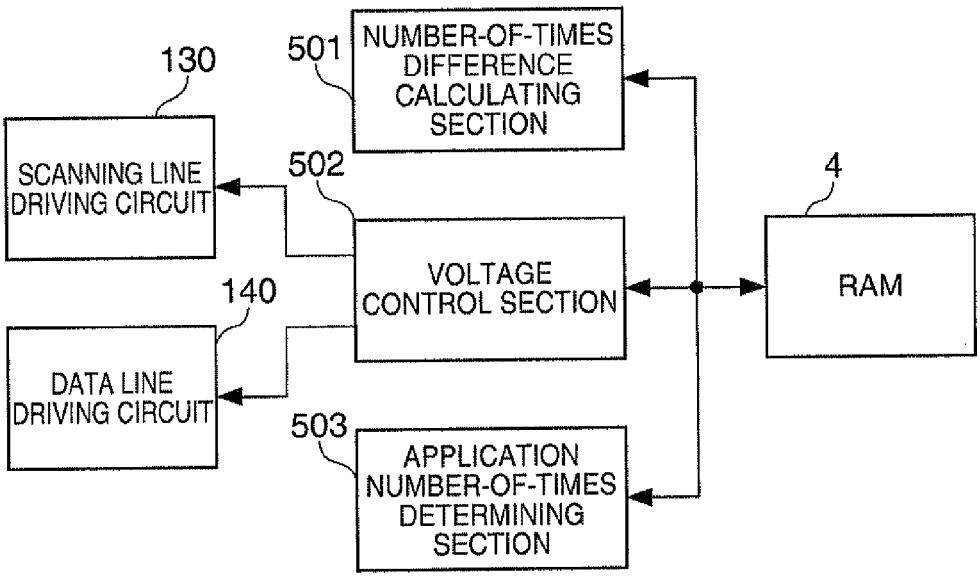
FIG. 5 is a block diagram showing the configuration of a function realized by a controller.

Next, the configuration of the controller 5 will be described. FIG. 5 is a block diagram showing functions realized in the controller 5. In the controller 5, a number-of-times difference calculating section 501, a voltage control section 502, and an application number-of-times determining section 503 are realized. In addition, each of the blocks may be realized by hardware, or may be realized by providing a CPU in the controller 5 and executing a program by the CPU.

The number-of-times difference calculating section 501 is a block which calculates the number-of-times difference for each pixel. The number-of--times difference calculating section 501 increments the value of the number-of-times difference storage region D(i, j) when the second voltage is applied to the pixel electrode 101*d* of the pixel P(i, j) corresponding to the number-of-times difference storage region D(i, j) and decrements the value of the number-of-times difference storage region D(i, j) when the first voltage is applied to the pixel electrode 101*d* of the pixel P(i, j) corresponding to the number-of-times difference storage region D(i, j), and calculates a difference between the number of times of application of the first voltage and the number of times of application of the second voltage. The number-of-times difference calculating section 501 writes the difference between the number of times of application of the first voltage and the number of times of application of the second voltage in the number-of-times difference storage region D(i, j).

When the value of the number-of-times difference storage region D(i, j) is not a predetermined value at the timing when the value of the remaining number-of-times storage region B(i, j) of the voltage control section 502 is 0, the voltage control section 502 controls the scanning line driving circuit 130 and the data line driving circuit 140 until the value of the number-of-times difference storage region D(i, j) becomes the predetermined value to apply the first or second voltage to the pixel electrode 101*d*. In addition, when the value of the number-of-times difference storage region D(i, j) is not a predetermined value at the timing when the value of the buffer A(i, j) and the value of the planned image storage region E(i, j) are different, the voltage control section 502 controls the scanning line driving circuit 130 and the data line driving circuit 140 until the value of the number-of-times difference storage region D(i, j) becomes the predetermined value to apply the first or second voltage to the pixel electrode 101*d*. In addition, the voltage control section 502 controls the scanning line driving circuit 130 and the data line driving circuit 140 on the basis of the value of the planned image storage region E(i, j) and the value of the remaining number-of-times storage region B(i, j) to apply the first or second voltage to the pixel electrode 101*d*. In addition, when changing the gray level of a pixel before a voltage is applied to the pixel multiple times, the voltage control section 502 starts a new operation of applying the voltage to the pixel multiple times even in the middle of the writing operation.

The application number-of-times determining section 503 is a block which determines the number of times of application of the first or second voltage for changing the gray level of the pixel P(i, j) on the basis of the value of the gray level value storage region C(i, j), the value of the buffer A(i, j), and a table shown in FIG. 6 which will be described later. The application number-of-times determining section 503 writes the determined number of times of application in the remaining number-of-times storage region B(i, j).

Moreover, in the present embodiment, the minimum number of times of voltage application (the number of frames) required to change the display state from white to black is different from the minimum number of times of voltage application (the number of frames) required to change the display state from black to white. FIG. 6 is a view showing the minimum number of times of voltage application required to change the gray level. The controller 5 stores the table shown in FIG. 6. In the present embodiment, the gray level of the pixel 110 changes in six levels of 0 to 5, and the density increases as the gray level value decreases. The gray level value of 0 is defined as black, and the gray level value of 5 is defined as white.

Figure 6:
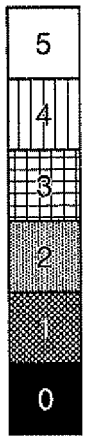
FIG. 6 is a view showing the minimum number of times of voltage application required to change the gray level.

Referring to FIG. 6, in the present embodiment, when a voltage of −15 V with the voltage Vcom of the common electrode layer 103*b* as a reference is applied five times to the pixel electrode 101*d* from the state where the gray level value is 0 (state where the pixel is black), the gray level value becomes 5 (pixel becomes white). On the other hand, when a voltage of +15 V with the voltage Vcom of the common electrode layer 103*b* as a reference is applied three times to the pixel electrode 101*d* from the state where the gray level value is 5 (state where the pixel is white), the gray level value becomes 0 (pixel becomes black).

Image rewriting can be quickly performed if a voltage is applied by the minimum number of times required to change the gray level. However, since the number of times of voltage application when changing the display state of a pixel from black to white is different from that when changing the display state of a pixel from white to black, a difference between the number of times of application of a positive voltage with the common electrode layer 103*b* as a reference and the number of times of application of a negative voltage with the common electrode layer 103*b* as a reference occurs. This may deteriorate a microcapsule quickly. In the present embodiment, therefore, a large difference does not occur between the number of times of application of a positive voltage with the voltage Vcom of the common electrode layer 103*b* as a reference and the number of times of application of a negative voltage with the voltage Vcom of the common electrode layer 103*b* as a reference. Hereinafter, the operation will be described.

First Operation Example of the First Embodiment

Next, an operation of the present embodiment will be described. FIGS. 7 to 10 are flow charts showing the flow of processing performed by the controller 5. In addition, FIG. 11 is a view showing the content of each storage region changing with time. FIG. 11 shows the content of a buffer A(1, 1), a remaining number-of-times storage region B(1, 1), a gray level value storage region C(1, 1), a number-of-times difference storage region D(1, 1), and a planned image storage region E(1, 1) corresponding to one pixel P(1, 1). In addition, the content of each storage region is a value after a frame period ends. In addition, FIG. 11 also shows the polarity of a voltage, which is applied to the pixel electrode 101*d* in one frame period, with respect to the common electrode layer 103*b*.

First, in the first frame shown in FIG. 11, the buffer A(1, 1) is 5, the gray level value storage region C(1, 1) is 5, and the remaining number-of-times storage region B(1, 1) and the number-of-times difference storage region D(1, 1) are 0. Here, until the third frame starts, the voltage applied to the pixel electrode 101*d* is the same as the voltage Vcom, and the value of each storage region does not change.

Figure 7:
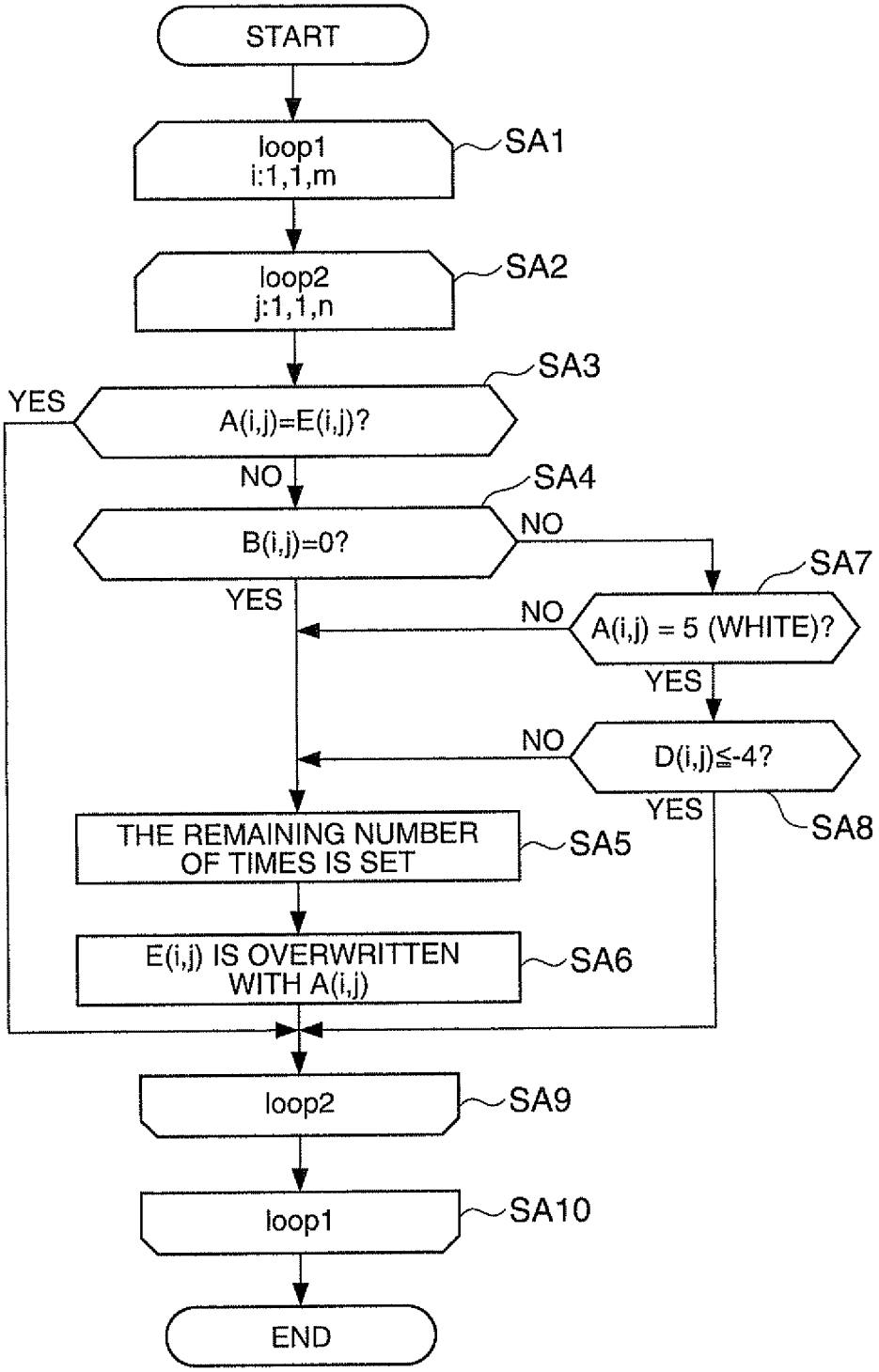
FIG. 7 is a flow chart showing the flow of processing performed by a controller in the first embodiment.

Then, when the content of the VRAM 3 is rewritten before the start of the third frame, the controller 5 performs the processing shown in FIG. 7 before the start of the frame period. Specifically, the controller 5 rewrites the content of the remaining number-of-times storage region B and the planned image storage region E according to the content of each storage region.

First, the controller 5 initializes variables i and j to set them to 1 (steps SA1 and SA2). Then, the controller 5 determines whether or not the value of the buffer A(i, j) is the same as the value of the planned image storage region E(i, j). When the value of the buffer A(i, j) is the same as the value of the planned image storage region E(i, j) (YES in step SA3), the controller 5 proceeds to step SA9.

On the other hand, when the value of the buffer A(i, j) is different from the value of the planned image storage region E(i, j) (NO in step SA3), the controller 5 determines whether or not the remaining number-of-times storage region B(i, j) is 0. When the remaining number-of-times storage region B(i, j) is 0 (YES in step SA4), the controller 5 writes the remaining number of times of application in the remaining number-of-times storage region B(i, j) on the basis of the buffer A(i, j), the gray level value storage region C(i, j), and the table shown in FIG. 6 (step SA5). After the end of step SA5, the controller 5 overwrites the value of the planned image storage region E(i, j) with the value of the buffer A(i, j).

In addition, when the value of the remaining number-of-times storage region B(i, j) is not 0 (NO in step SA4), the controller 5 determines whether or not the value of the buffer A(i, j) is 5 (white). When the value of the buffer A(i, j) is not 5 (NO in step SA7), the controller 5 proceeds to step SA5. On the other hand, when the value of the buffer A(i, j) is 5 (YES in step SA7), the controller 5 determines whether or not the value of the number-of-times difference storage region D(i, j) is equal to or smaller than a threshold value (in the present embodiment, −4) set in advance (in other words, when the value of the buffer A(i, j) is 5 (YES in step SA7), the controller 5 determines whether or not the absolute value of the value of the number-of-times difference storage region D (i, j) is larger by 4 or more than the threshold value set in advance). When the value of the number-of-times difference storage region D(i, j) is not equal to or smaller than the threshold value (NO in step SA8), the controller 5 proceeds to step SA5. In addition, when the value of the number-of-times difference storage region D(i, j) is equal to or smaller than the threshold value (YES in step SA8), the controller 5 proceeds to step SA9.

In step SA9, the controller 5 determines whether or not the value of the variable j is n. When the value of the variable j is not n, the controller 5 increments the variable j and proceeds to step SA3. In addition, when the value of the variable j is n, the controller 5 determines whether or not the value of the variable i is m in step SA10. When the value of the variable i is not m, the controller 5 increments the variable i and proceeds to step SA2. In addition, when the value of the variable i is m, the controller 5 ends the processing shown in FIG. 7.

For example, when the buffer A(1, 1) is rewritten from 5 to 0 before the start of the third frame and the value of the buffer A(1, 1) is different from the value (5) of the planned image storage region E(1, 1) before the start of the third frame (NO in step SA3), the controller 5 determines whether or not the remaining number-of-times storage region B(1, 1) is 0. When the remaining number-of--times storage region B(1, 1) is 0 at the time before the start of the third frame as shown in FIG. 11 (YES in step SA4), the controller 5 writes the number of times of voltage application, which is required to change the gray level of the pixel P(1, 1) from 5 to 0, in the remaining number-of-times storage region B(1, 1) (step SA5). Referring to FIG. 6, the number of times of voltage application required to change the gray level of a pixel from 5 which is a value of the gray level value storage region C(i, j) to 0 which is a value of the buffer A(i, j) is 3. Accordingly, the controller 5 writes 3 in the remaining number-of-times storage region B(1, 1). In addition, the controller 5 overwrites the value of the planned image storage region E(i, j) with 0 which is a value of the buffer A(i, j) (step SA6).

The controller 5 drives the scanning line driving circuit 130 and the data line driving circuit 140 in a frame period after the processing shown in FIG. 7 ends. The controller 5 performs processing shown in FIGS. 8 to 10 when driving the data line driving circuit. First, the controller 5 initializes the variables i and j to set them to 1 (steps SB1 and SB2). Then, the controller 5 determines whether or not the value of the buffer A(i, j) is 0. When the value of the buffer A(i, j) is 0 (black) (YES in step SB3), the controller 5 performs processing shown to FIG. 9 in step S24.

First, the controller 5 determines whether or not the value of the remaining number-of-times storage region B(i, j) is 0. In addition, when the value of the remaining number-of-times storage region B(i, j) is not 0 (NO in step SC1), the controller 5 decrements the value of the remaining number-of-times storage region B(i, j) (step SC2). In addition, the controller 5 sets the data line 114 on the j-th column to +15 V with the voltage Vcom as a reference (step SC3) and then increments the value of the number-of-times difference storage region D(i, j) (step SC4). Then, the controller 5 updates the value of the gray level value storage region C(i, j) (step SC5), and proceeds to step SC6.

In addition, when the value of the remaining number-of-times storage region B(i, j) is 0 (YES in step SC1), the controller 5 determines whether or not the value of the number-of-times difference storage region D(i, j) is smaller than 5. When the value of the number-of-times difference storage region D(i, j) is smaller than 5 (YES in step SC6), the controller 5 proceeds to step SC3. When the value of the number-of-times difference storage region D(i, j) is equal to or larger than the threshold value (here, 5) set in advance (NO in step SC6), the controller 5 sets the data line 114 on the j-th column to 0 V with the voltage Vcom as a reference (step SC7), and proceeds to step SB6.

Figure 10:
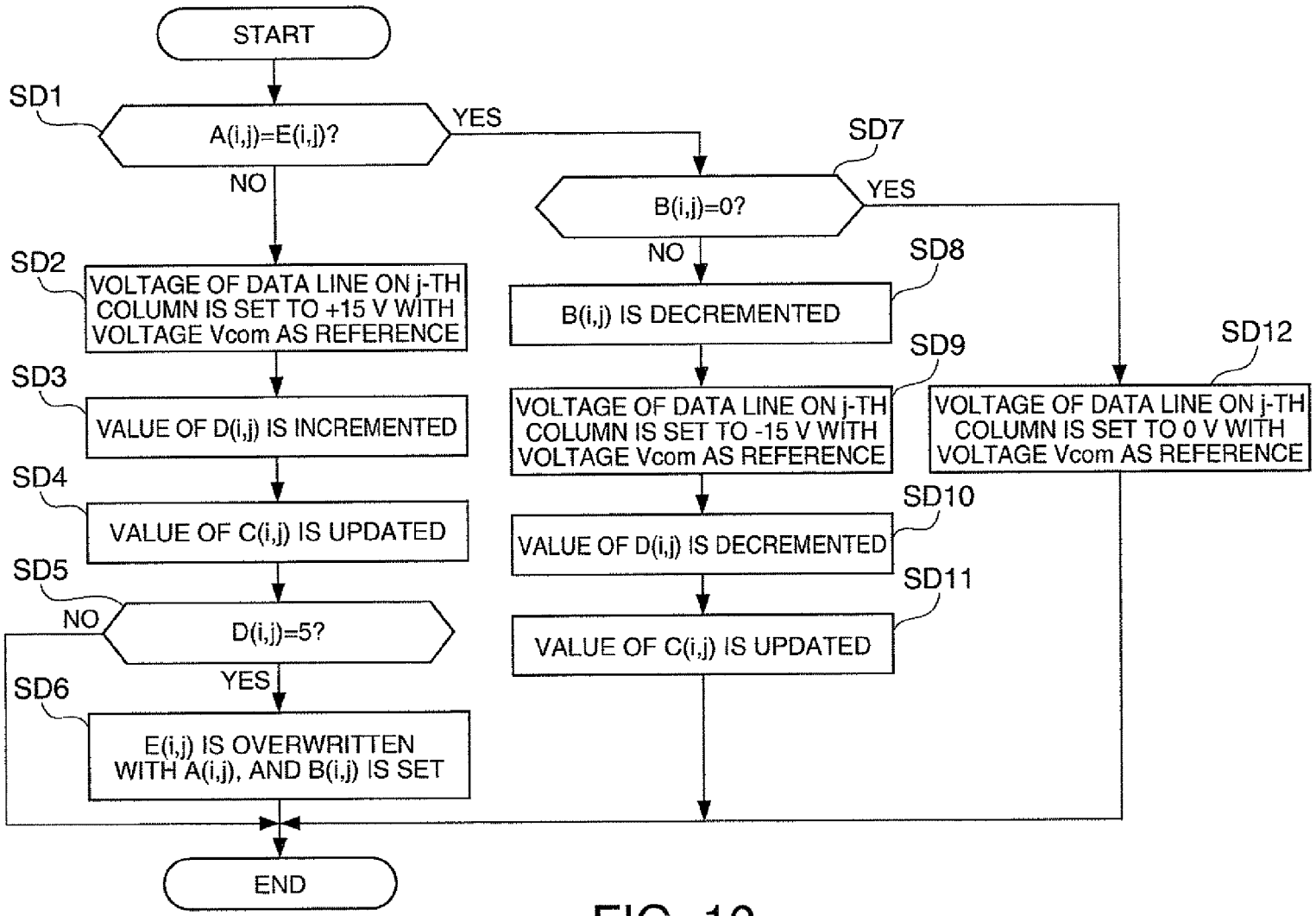
FIG. 10 is a flow chart showing the flow of processing performed by the controller in the first embodiment.
Figure 11:
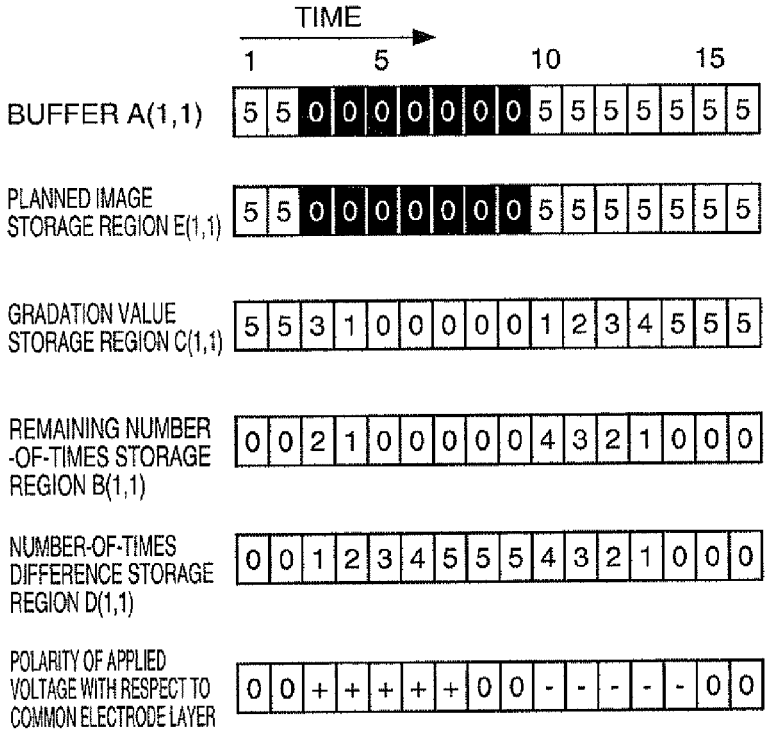
FIG. 11 is a view for explaining an operation in the first embodiment.

Referring back to FIG. 8, when the value of the buffer A(i, j) is 5 (white) (NO in step SB3), the controller 5 performs processing shown in FIG. 10. The controller 5 determines whether or not the value of the buffer A(i, j) is the same as the value of the planned image storage region E(i, j). When the value of the buffer A(i, j) is different from the value of the planned image storage region E(i, j) (NO in step SD1), the controller 5 sets the data line 114 on the j-th column to +15 V with the voltage Vcom as a reference (step SD2) and then increments the value of the number-of-times difference storage region D(i, j) (step SD3). Then, the controller 5 updates the value of the gray level value storage region C(i, j) (step SD4). Then, when the value of the number-of-times difference storage region D(i, j) is 5 (YES in step SD5), the controller 5 overwrites the value of the planned image storage region E(i, j) with the value of the buffer A(i, j) (step SD6). After the end of step SD6, the controller 5 proceeds to step SB6. In addition, when the value of the number-of-times difference storage region D(i, j) is not 5 (NO in step SD5), the controller 5 proceeds to step SB6.

In addition, when YES is determined in step SD1, the controller 5 determines whether or not the value of the remaining number-of-times storage region B(i, j) is 0. When the value of the remaining number-of-times storage region B(i, j) is 0 (YES in step SD7), the controller 5 sets the data line 114 on the j-th column to 0 V with the voltage Vcom as a reference (step SD12), and proceeds to step S36.

In addition, when NO is determined in step SD7, the controller 5 decrements the value of the remaining number-of-times storage region B(i, j) (step SD8). Then, the controller 5 sets the data line 114 on the j-th column to −15 V with the voltage Vcom as a reference (step SD9), and decrements the value of the number-of-times difference storage region D (i, j) (step SD10). Then, the controller 5 updates the value of the gray level value storage region C(i, j) (step SD11). After the end of step SD11, the controller 5 proceeds to step SB6.

Referring back to FIG. 8, the controller 5 determines whether or not the value of the variable j is n in step SB6. When the value of the variable j is not n, the controller 5 increments the variable j and proceeds to step SB3. In addition, when the value of the variable j is n, the controller 5 drives a scanning line on the i-th row (step SB7). Then, the controller 5 determines whether or not the value of the variable i is m in step SB8. When the value of the variable i is not m, the controller 5 increments the variable i and proceeds to step SB2. In addition, when the value of the variable i is m, the controller 5 ends the processing shown in FIG. 8.

For example, at the start of the third frame, the value of the buffer A(1, 1) is 0 (YES in step SB3) and the value of the remaining number-of-times storage region B(1, 1) is 3 (NO in step SC1). Accordingly, the controller 5 decrements the value of the remaining number-of-times storage region B(1, 1) to set it to 2 (step SC2). After setting the data line 114 on the first column to +15 V with the voltage Vcom as a reference (step SC3), the controller 5 increments the value of the number-of--times difference storage region D(1, 1) to set it to 1 (step SC4).

Then, the controller 5 updates the value of the gray level value storage region C(1, 1) (step SC5). In addition, when a voltage of +15 V with the voltage Vcom as a reference is applied to the pixel electrode 101*d*, the actual variation in the gray level value of a pixel caused by one voltage application is 2. Therefore, when the third frame ends, the gray level value of the gray level value storage region C(1, 1) becomes 3. Then, when the scanning line 112 on the first row is driven (step SB7), a voltage of +15 V with the voltage Vcom as a reference is applied to the pixel electrode 101*d* of the pixel on the first row and the first column, such that black electrophoretic particles move toward the common electrode layer 103*b*.

Then, in the fourth and fifth frames, the controller 5 performs the same processing as in the third frame. Then, in the sixth frame, the operation of the controller 5 is as follows.

First, since the value of the buffer A(1, 1) is 0 (YES in step SB3) and the value of the remaining number-of-times storage region B(1, 1) is 0 (YES in step SC1), the controller 5 determines the value of the number-of-times difference storage region D(1, 1). In this case, since the value of the number-of-times difference storage region D(1, 1) is 3 which is less than 5 (YES in step SC6), the controller 5 sets the data line 114 on the first row to +15 V with the voltage Vcom as a reference (step SC3), and then increments the value of the number-of-times difference storage region D(1, 1) to set it to 4 (step SC4). Then, the controller 5 updates the value of the gray level value storage region C(1, 1) (step SC5). In addition, when the value of the gray level value storage region C(1, 1) is 0, the controller 5 holds the value 0 as it is.

In the seventh frame, the controller 5 performs the same processing as in the sixth frame. Then, in the eighth frame, the operation of the controller 5 is as follows.

First, since the value of the buffer A(1, 1) is 0 (YES in step SB3) and the value of the remaining number-of-times storage region B(1, 1) is 0 (YES in step SC1), the controller 5 determines the value of the number-of-times difference storage region D(1, 1). In this case, since the value of the number-of-times difference storage region D(1, 1) is 5 (NO in step SC6), the controller 5 sets the data line 114 on the first column to 0 V with the voltage Vcom as a reference (step SC7).

Next, when the buffer A(1, 1) is rewritten from 0 (black) to 5 (white) before the start of the tenth frame, the operation of the controller 5 is as follows.

Since the value of the buffer A(1, 1) is different from the value (0) of the planned image storage region E(1, 1) before the start of the tenth frame (NO in step SA3), the controller 5 determines whether or not the remaining number-of-times storage region B(1, 1) is 0. When the remaining number-of-times storage region B(1, 1) is 0 at the time before the start of the tenth frame (when the ninth frame ends) as shown in FIG. 11 (YES in step SA4), the controller 5 writes the number of times of voltage application, which is required to change the gray level of the pixel P(1, 1) from 5 to 0, in the remaining number-of-times storage region B(1, 1) (step SA5). Referring to FIG. 6, since the number of times of voltage application required to change the gray level of a pixel from 5 to 0 is 3, the controller 5 writes 3 in the remaining number-of-times storage region B(1, 1). Then, the controller 5 overwrites the value of the planned image storage region E(i, j) with 5 which is a value of the buffer A(i, j) (step SA6).

Then, in a subsequent frame period, the controller 5 determines whether or not the value of the buffer A(i, j) is 0. When the value of the buffer A(i, j is 5 (white) (NO in step SB3), the controller 5 performs processing shown to FIG. 10.

First, since the value of the buffer A(i, j) and the value of the planned image storage region E(i, j) are the same (YES in step SD1) and the value of the remaining number-of-times storage region B(i, j) is not 0 (NO in step SD7), the controller 5 decrements the value of the remaining number-of-times storage region B(1, 1) to set it to 4 (step SD8). Then, the controller 5 sets the data line 114 on the first column to −15 V with the voltage Vcom as a reference (step SD9), and then decrements the value of the number-of-times difference storage region D(1, 1) to set it to 4 (step SD10). Then, the controller 5 updates the value of the gray level value storage region C(1, 1) (step SD11). In addition, when a voltage of −15 V with the voltage Vcom as a reference is applied to the pixel electrode 101*d*, the actual variation in the gray level value of a pixel caused by one voltage application is 1. Therefore, when the tenth frame ends, the gray level value of the gray level value storage region C(1, 1) becomes 4. Then, when the scanning line 112 on the first row is driven (step SB7), a voltage of −15 V with the voltage Vcom as a reference is applied to the pixel electrode 101*d* of the pixel on the first row and the first column, such that white electrophoretic particles move toward the common electrode layer 103*b*.

Then, the controller 5 applies a voltage to the pixel electrode 101*d* in each frame period until the value of the remaining number-of-times storage region B(1, 1) becomes 0. When the content of the remaining number-of-times storage region B(1, 1) becomes 0 at the start of the fifteenth frame, the controller 5 applies the same voltage as the voltage Vcom to the pixel electrode 101*d* in the fifteenth frame.

Second Operation Example of the First Embodiment

Figure 12:
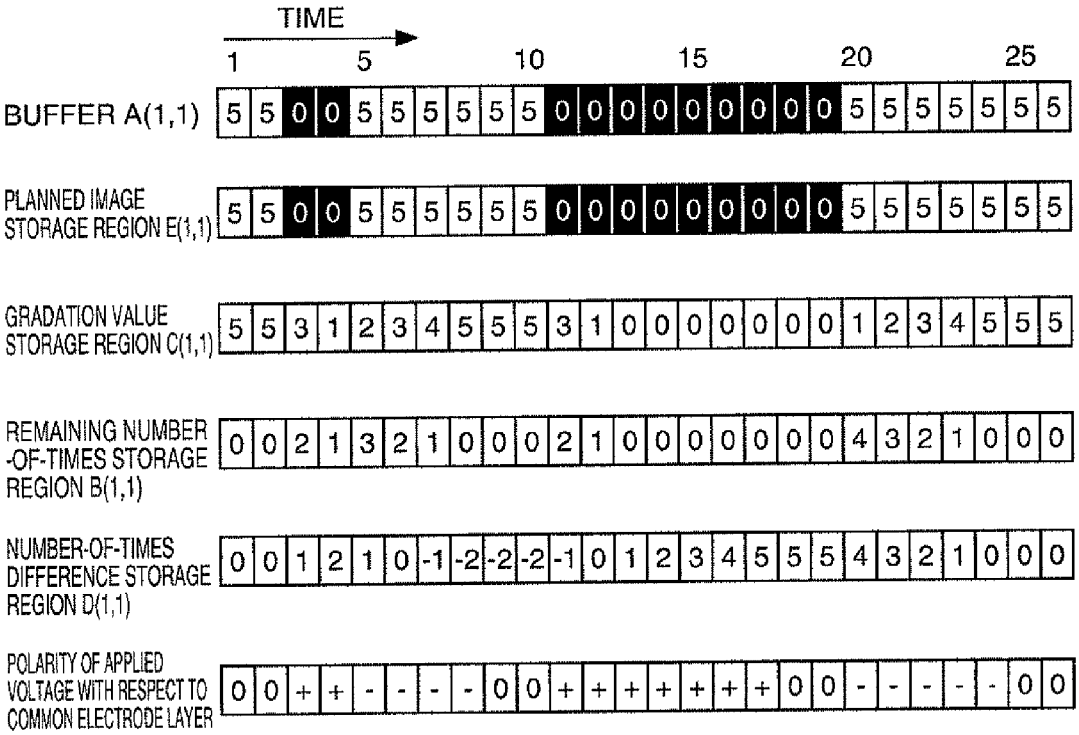
FIG. 12 is a view for explaining an operation in the first embodiment.

Next, an operation when the content of the VRAM 3 is changed before the value of the remaining number-of-times storage region becomes 0 will be described with reference to FIG. 12. FIG. 12 is also a view showing the content of each storage region changing with time. FIG. 12 shows the content of the buffer A(1, 1), the remaining number-of-times storage region B(1, 1), the gray level value storage region C(1, 1), and the number-of-times difference storage region D(1, 1) corresponding to one pixel P(1, 1). In addition, since the operation in first to fourth frames in FIG. 12 is the same as the operation in the first to fourth frames in FIG. 11, explanation thereof will be omitted.

Before the value of the remaining number-of-times storage region B(1, 1) regarding the pixel P(1, 1) becomes 0, the controller 5 determines NO in step SA3 and determines NO in step SA4 if 5 (white) is written in the buffer A(1, 1) as the gray level value of the pixel 110 before the fifth frame. In addition, since the value of the buffer A(1, 1) is 5 (YES in step SA7) and the value of the number-of-times difference storage region D(1, 1) is 2, the controller 5 writes 4 in the remaining number-of-times storage region B(1, 1) in step SA5, and writes 5 in the planned image storage region E(1, 1) in step SA6.

Then, in the fifth to eighth frames, the controller 5 sets the voltage of the pixel electrode 101*d* of the pixel P(1, 1) to −15 V with the voltage Vcom as a reference. When the value of the remaining number-of-times storage region B(1, 1) becomes 0 (ninth and tenth frames), the controller 5 sets the voltage of the pixel electrode 101*d* of the pixel P(1, 1) to the same voltage as the voltage Vcom.

Then, when 0 (black) is written in the buffer A(1, 1) as the gray level value of the pixel 110 before the eleventh frame, the controller 5 sets the voltage of the pixel electrode 101*d* of the pixel P(1, 1) to +15 V with the voltage Vcom as a reference until the value of the number-of-times difference storage region D(1, 1) becomes 5, in the same manner as in the frames from the third frames shown in FIG. 11. Then, when 5 (white) is written in the buffer A(1, 1) as the gray level value of the pixel 110 before the twentieth frame, the controller 5 sets the voltage of the pixel electrode 101*d* of the pixel P(1, 1) to −15 V with the voltage Vcom as a reference until the value of the remaining number-of-times storage region B(1, 1) becomes 0, in the same manner as in the frames from the tenth frames shown in FIG. 11.

Third Operation Example of the First Embodiment

Figure 13:
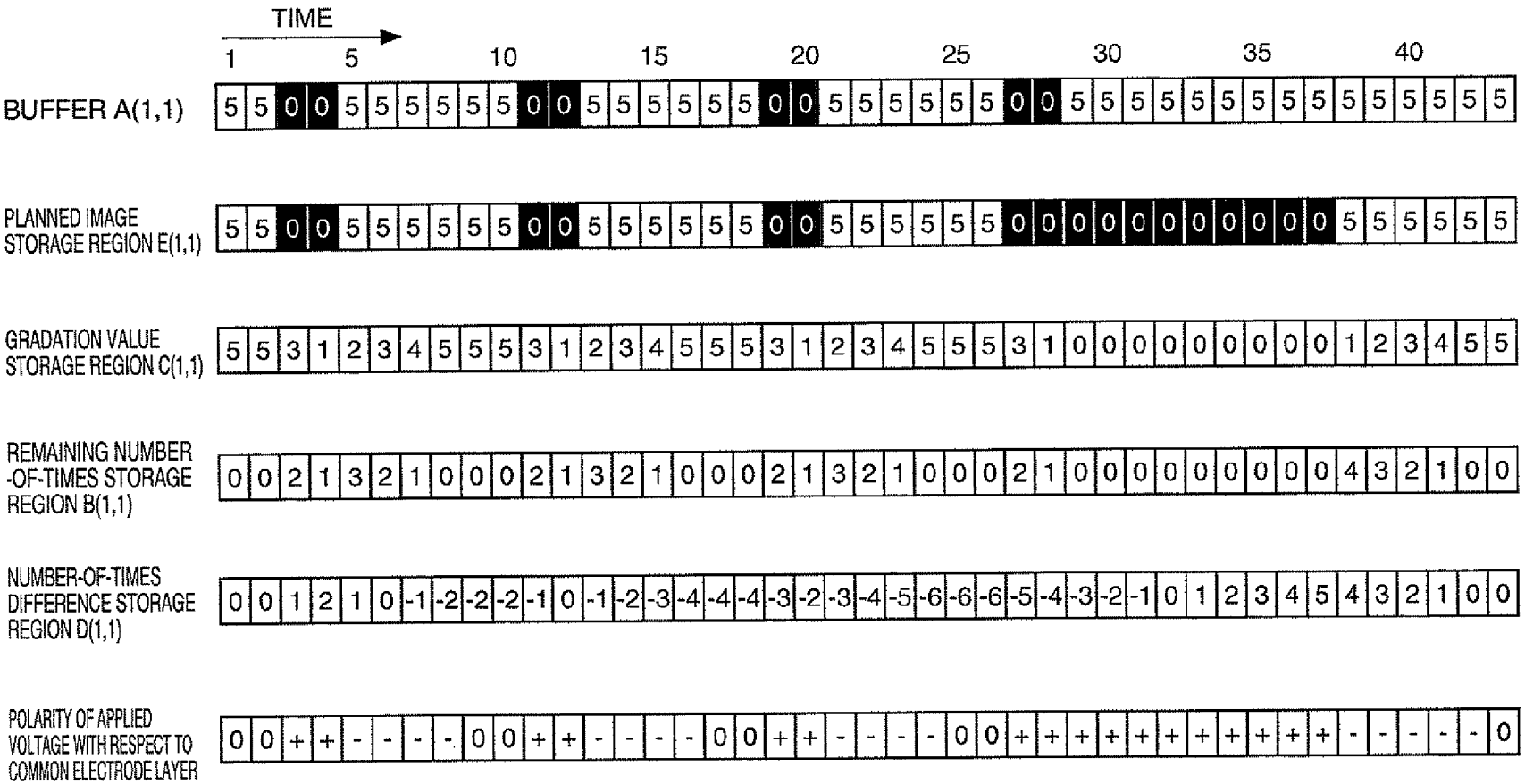
FIG. 13 is a view for explaining an operation in the first embodiment.

Next, a case where the operation of changing the content of the buffer A(1, 1) is repeated before the value of the remaining number-of-times storage region B(1, 1) becomes 0 will be described with reference to FIG. 13. FIG. 13 is also a view showing the content of each storage region changing with time. FIG. 13 shows the content of the buffer A(1, 1), the remaining number-of-times storage region B(1, 1), the gray level value storage region C(1, 1), and the number-of-times difference storage region D(1, 1) corresponding to one pixel P(1, 1). In addition, since the operation in first to twelfth frames in FIG. 13 is the same as the operation in the first to twelfth frames in FIG. 12, explanation thereof will be omitted.

When 5 (white) is written in the buffer A(1, 1) as the gray level value of the pixel 110 before the thirteenth frame, the controller 5 performs the same operation as in the fifth to eighth frames. Then, when 0 (black) is written in the buffer A(1, 1) as the gray level value of the pixel 110 before the nineteenth frame and 5 (white) is written in the buffer A(1, 1) as the gray level value of the pixel 110 before the twenty-first frame, the controller 5 performs the same operation as in the third to eighth frames for the nineteenth to twenty-fourth frames. In addition, when 0 (black) is written in the buffer A(1, 1) as the gray level value of the pixel 110 before the twenty-seventh frame, the controller 5 performs the same operation as in the third and fourth frames for the twenty-seventh and twenty-eighth frames.

Then, when 5 (white) is written in the buffer A(1, 1) as the gray level value of the pixel 110 before the twenty-ninth frame, the controller 5 determines NO in step SA3 and determines NO in step SA4. In addition, since the value of the buffer A(1, 1) is 5 (YES in step SA7), the controller 5 determines the value of the number-of-times difference storage region D(1, 1). In this case, since the value of the number-of-times difference storage region D(1, 1) is −4, the controller 5 determines YES in step SA8 and does not update the content of the planned image storage region E(1, 1).

Then, in a subsequent frame period, the controller 5 performs processing in step SB5 since the value of the buffer A(1, 1) is 5. First, since the value of the buffer A(1, 1) is different from the value of the planned image storage region E(1, 1) (NO in step SD1), the controller 5 sets the data line 114 on the first column to +15 V with the voltage Vcom as a reference (step SD2) and then increments the value of the number-of-times difference storage region D(1, 1) to set it to −3. In addition, the controller 5 updates the value of the gray level value storage region C(1, 1) to 0. Then, the controller 5 determines whether or not the value of the number-of-times difference storage region D(1, 1) is 5. In this case, since the value of the number-of-times difference storage region D(1, 1) is −3, the controller 3 determines NO in step SD5 and the value of the planned image storage region E(1, 1) is held as 0 as it is.

Then, when the scanning line 112 on the first row is driven (step SB7), a voltage of +15 V with the voltage Vcom as a reference is applied to the pixel electrode 101*d* of the pixel on the first row and the first column, such that black electrophoretic particles move toward the common electrode layer 103*b* even though the value of the buffer A(1, 1) is 5 indicating the white as the gray level of a pixel.

In the thirtieth to thirty-sixth frames, the controller 5 performs the same operation as in the twenty-ninth frame for the pixel P(1, 1). In the thirty-seventh frame, the value of the buffer A(1, 1) is different from the value of the planned image storage region E(1, 1) (NO in step SD1). Accordingly, the controller 5 sets the data line 114 on the first column to +15 V with the voltage Vcom as a reference (step SD2) and then increments the value of the number-of-times difference storage region D(1, 1) to set it to 5. Then, since the value of the number-of-times difference storage region D(1, 1) is 5 (NO in step SD5), the controller 5 overwrites the value of the planned image storage region E(1, 1) with 5 which is a value of the buffer A(1, 1), and writes the value in the remaining number-of-times storage region B(1, 1) on the basis of the buffer A(1, 1), the gray level value storage region C(1, 1), and the table shown in FIG. 6.

In the thirty-eighth frame, the controller 5 performs processing in step SB5 since the value of the buffer A(1, 1) is 5. Since the value of the buffer A(1, 1) and the value of the planned image storage region E(1, 1) are the same and the value of the remaining number-of-times storage region B(1, 1) is not 0, the controller 5 performs processing in steps SD8 to SD11. That is, a voltage of −15 V with the voltage Vcom as a reference is applied to the pixel electrode 101*d* on the first row and the first column.

Then, until the forty-second frame, the controller 5 applies a voltage of −15 V with the voltage Vcom as a reference to the pixel electrode 101*d* of the pixel P(1, 1).

If a voltage of −15 V with the voltage Vcom as a reference is applied to the pixel electrode 101*d* of the pixel P(1, 1) from the twenty-ninth frame by rewriting the buffer A(1, 1), the absolute value of the value of the number-of-times difference storage region D(1, 1) increases further. That is, in the pixel P(1, 1), a large difference occurs between the number of times of application of a positive voltage with the common electrode layer 103*b* as a reference and the number of times of application of a negative voltage with the common electrode layer 103*b* as a reference. As a result, the pixel 110 quickly deteriorates.

In contrast, in the present embodiment, the voltage applied to the pixel electrode 101*d* is controlled even if the content of the buffer storage region is rewritten, in the same manner as in the operation from the twenty-ninth frame. Accordingly, a large difference does not occur between the number of times of application of a positive voltage with the common electrode layer 103*b* as a reference and the number of times of application of a negative voltage with the common electrode layer 103*b* as a reference. As a result, it is possible to suppress deterioration of the pixel 110.

Second Embodiment

Next, a second embodiment of the present invention will be described. A display device according to the second embodiment has the same hardware configuration as in the first embodiment. The display device according to the second embodiment is different from the display device according to the first embodiment in that the gray level value storage region C is not provided, and processing of the controller 5 is also different between the display device according to the second embodiment and the display device according to the first embodiment. The following explanation will be given focusing on this different point.

Figure 14:
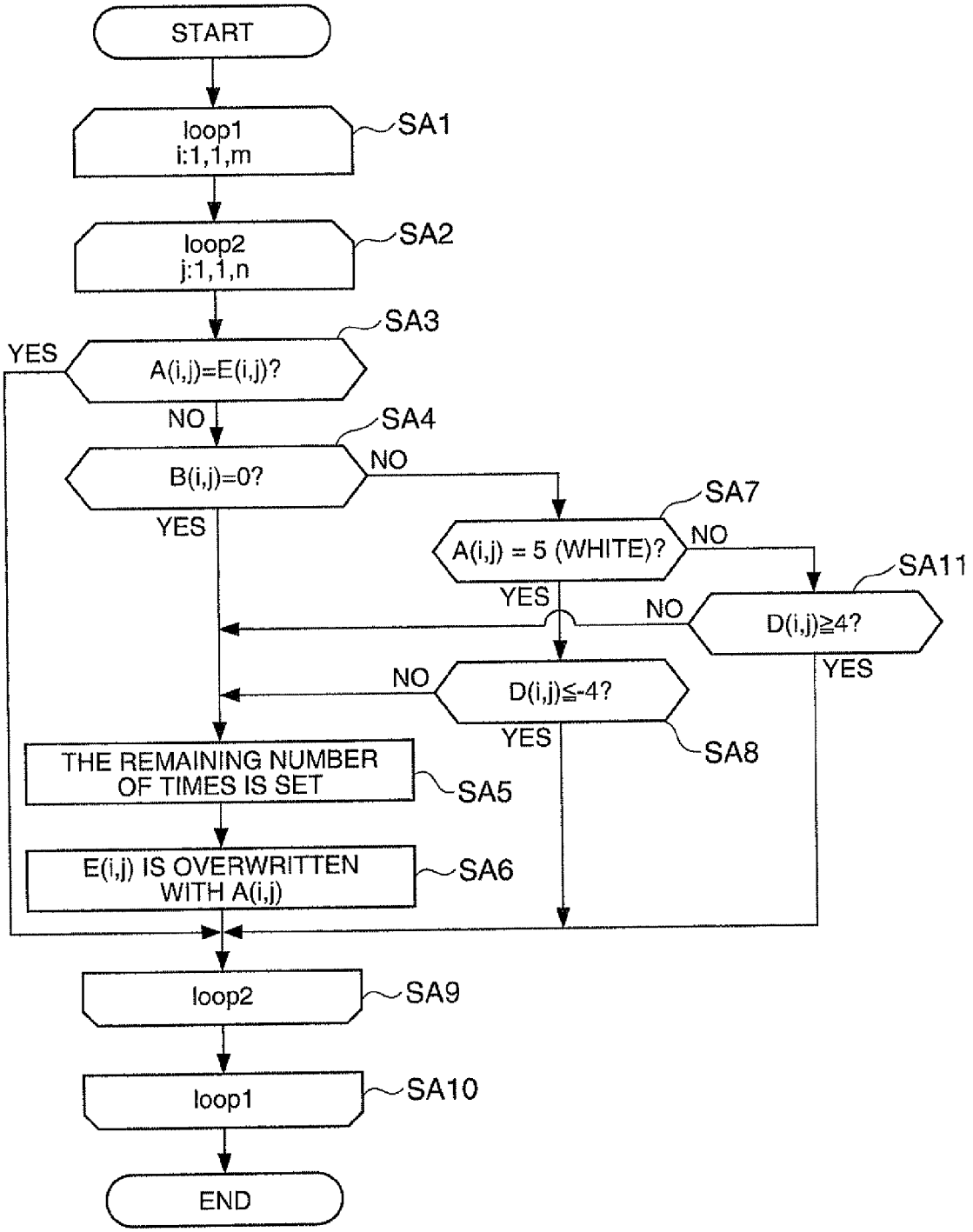
FIG. 14 is a flow chart showing the flow of processing performed by a controller in a second embodiment.
Figure 15:
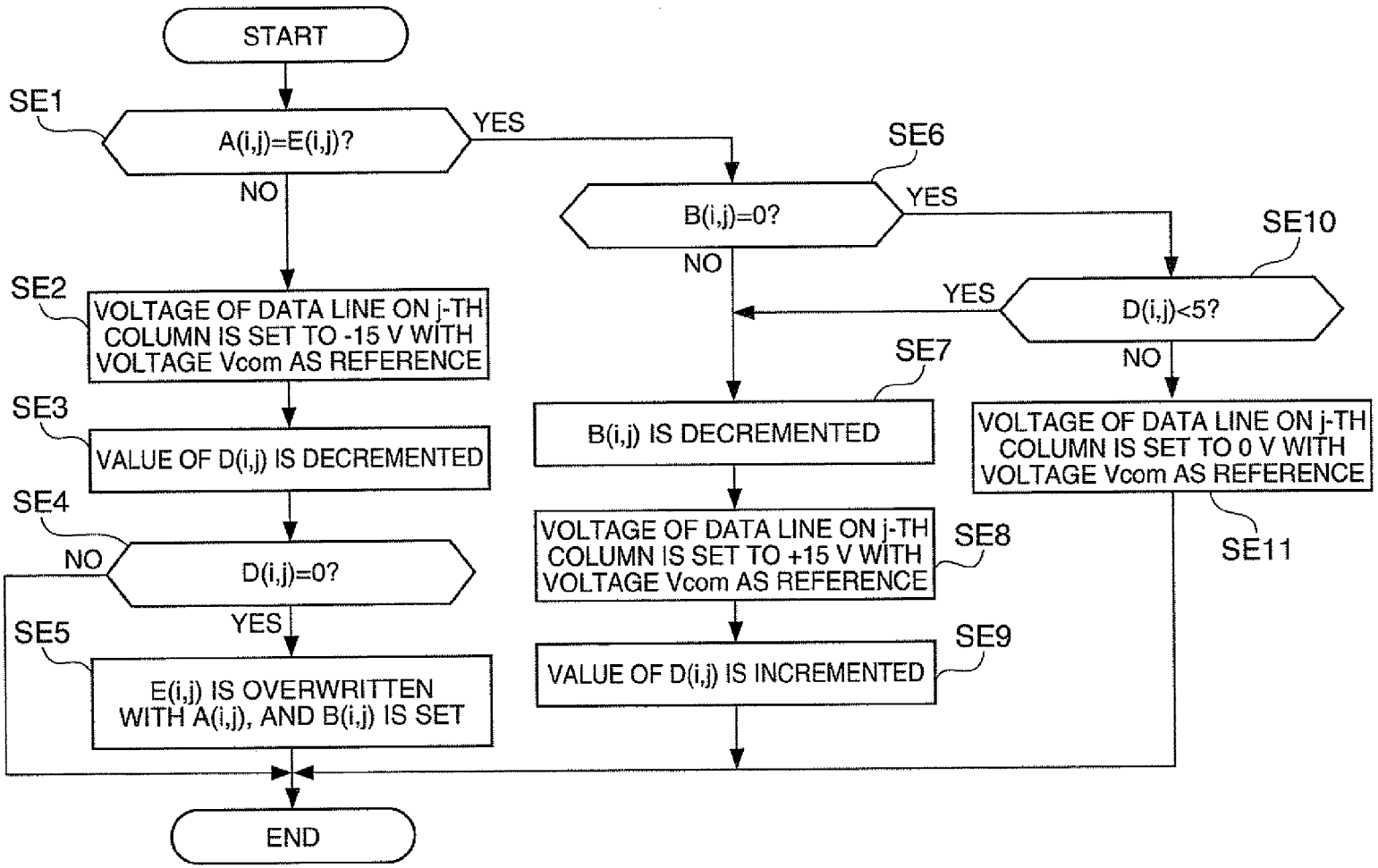
FIG. 15 is a flow chart showing the flow of processing performed by the controller in the second embodiment.
Figure 16:
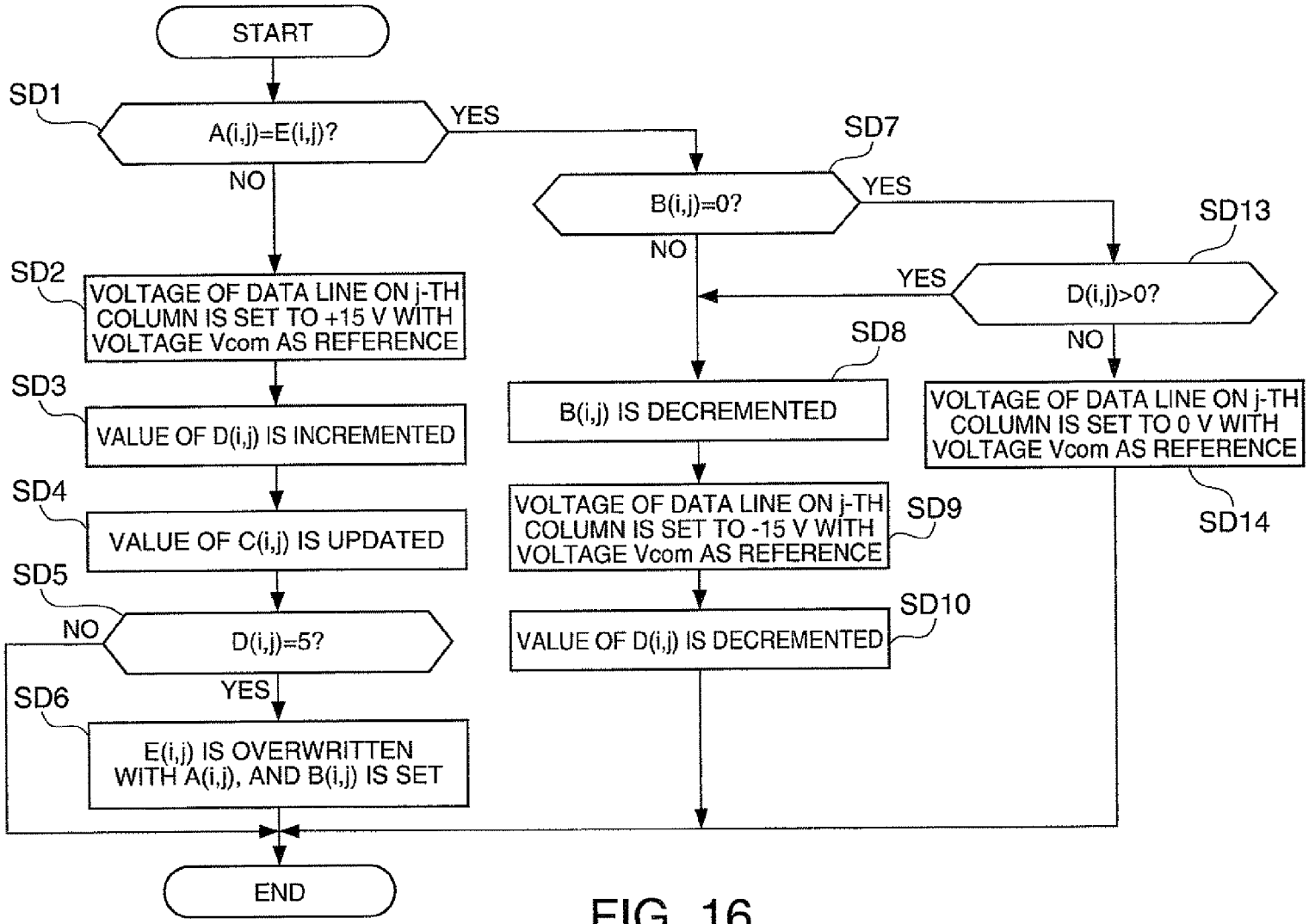
FIG. 16 is a flow chart showing the flow of processing performed by the controller in the second embodiment.

FIGS. 14 to 16 are flow charts showing the flow of processing performed by the controller 5. FIG. 14 is a view showing the flow of processing performed by the controller 5 when the content of the VRAM 3 is rewritten. The processing shown in FIG. 14 is different from the processing in the first embodiment shown in FIG. 7 in that step SA11 is included. When the value of the buffer A(i, j) is different from the value of the planned image storage region E(i, j), the value of the remaining number-of-times storage region B(i, j) is not 0, and the value of the buffer A(i, j) is 0, the controller 5 determines whether or not the value of the number-of-times difference storage region D(i, j) is equal to or larger than 4 in step SA11.

When the value of the number-of-times difference storage region D(i, j) is smaller than the threshold value (here, 4) set in advance in step SA11, the controller 5 proceeds to step SA5. On the other hand, when the value of the number-of-times difference storage region D(i, j) is equal to or larger than 4 in step SA11, the controller 5 proceeds to step SA9.

Figure 8:
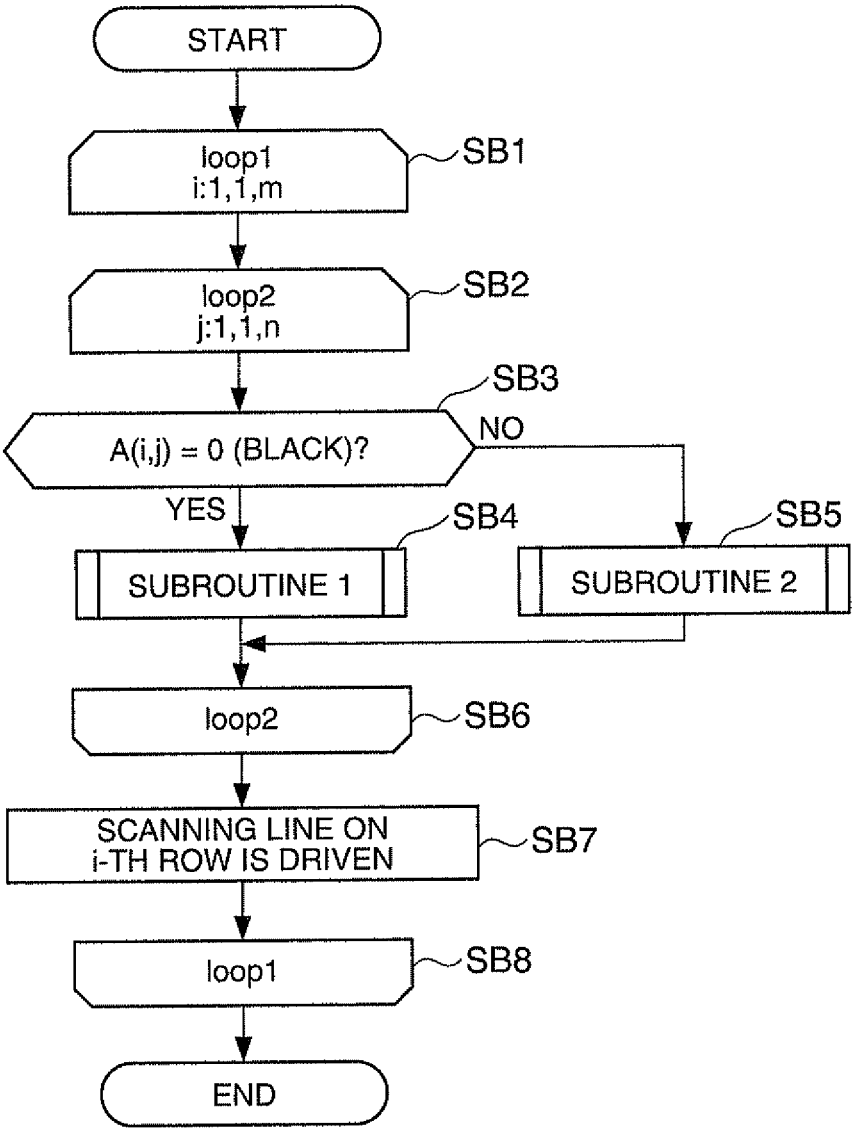
FIG. 8 is a flow chart showing the flow of processing performed by the controller in the first embodiment.
Figure 9:
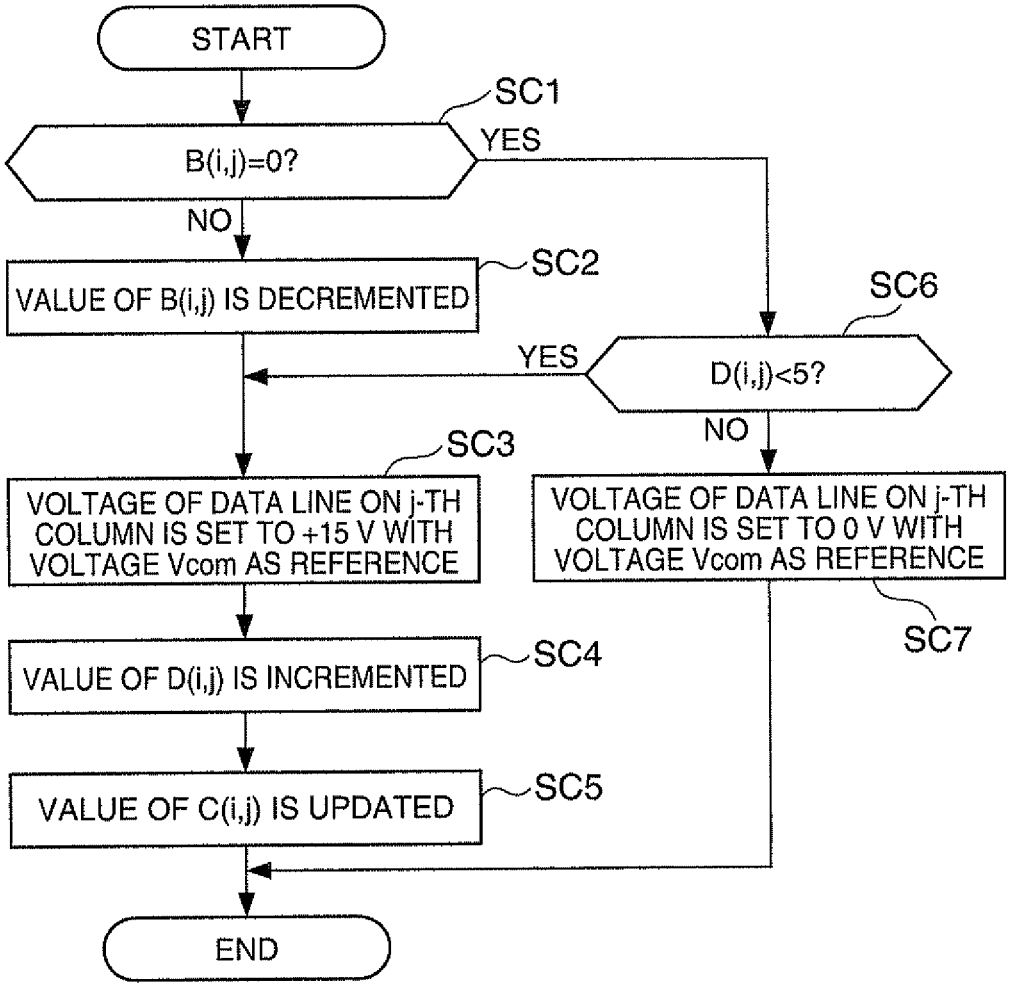
FIG. 9 is a flow chart showing the flow of processing performed by the controller in the first embodiment.

In addition, the processing shown in FIG. 8 is performed as processing when driving the data line driving circuit 140. In the present embodiment, however, the content in step SB4 is different from the content in step SB5. FIG. 15 is a flow chart showing the flow of processing in step SB4 (subroutine 1) in the present embodiment.

The controller 5 determines whether or not the value of the buffer A(i, j) is the same as the value of the planned image storage region E(i, j). When the value of the buffer A(i, j) is different from the value of the planned image storage region E(i, j) (NO in step SE1), the controller 5 sets the data line 114 on the j-th column to −15 V with the voltage Vcom as a reference (step SE2) and then decrements the value of the number-of-times difference storage region D(i, j) (step SE3). Then, when the value of the number-of-times difference storage region D(i, j) is 0 (YES in step SE4), the controller 5 overwrites the value of the planned image storage region E(i, j) with the value of the buffer A(i, j) (step SE5). After the end of step SE5, the controller 5 proceeds to step SB6. In addition, when the value of the number-of-times difference storage region D(i, j) is not 0 (NO in step SE4), the controller 5 proceeds to step S26.

In addition, when YES is determined in step SE1, the controller 5 determines whether or not the value of the remaining number-of-times storage region B(i, j) is 0. When the value of the remaining number-of-times storage region B(i, j) is 0 (YES in step SE6), the controller 5 determines whether or not the value of the number-of-times difference storage region D(i, j) is smaller than 5. When the value of the number-of-times difference storage region D(i, j) is smaller than 5 (YES in step SE10), the controller 5 proceeds to step SE7. On the other hand, when the value of the number-of-times difference storage region D(i, j) is not smaller than 5 (NO in step SE10), the controller 5 sets the data line 114 on the j-th column to 0 V with the voltage Vcom as a reference (step SE11), and proceeds to step SB6.

In addition, when NO is determined in step SE6, the controller 5 decrements the value of the remaining number-of-times storage region B(i, j) (step SE7). Then, the controller 5 sets the data line 114 on the j-th column to +15 V with the voltage Vcom as a reference (step SE8), and decrements the value of the number-of-times difference storage region D(i, j) (step SE9). After the end of step SE9, the controller 5 proceeds to step SB6.

FIG. 16 is a flowchart showing the flow of processing in step SB5 (subroutine 2) in the present embodiment. The processing shown in FIG. 10 is the same processing as in the first embodiment except that the processing in steps SD4 and SD11 is not included and steps SD13 and SD14 are included. In addition, the processing in step SD14 is the same processing as in step SD12 in the first embodiment. When the value of the number-of-times difference storage region D(i, j) is larger than 0 in step SD13 (YES in step SD13), the controller 5 proceeds to step SD8. On the other hand, when the value of the number-of-times difference storage region D(i, j) is equal to or smaller than 0 (NO in step SD13), the controller 5 sets the data line 114 on the j-th column to 0 V with the voltage Vcom as a reference (step SE11), and proceeds to step SB6.

First Operation Example of the Second Eembodiment

Figure 17:
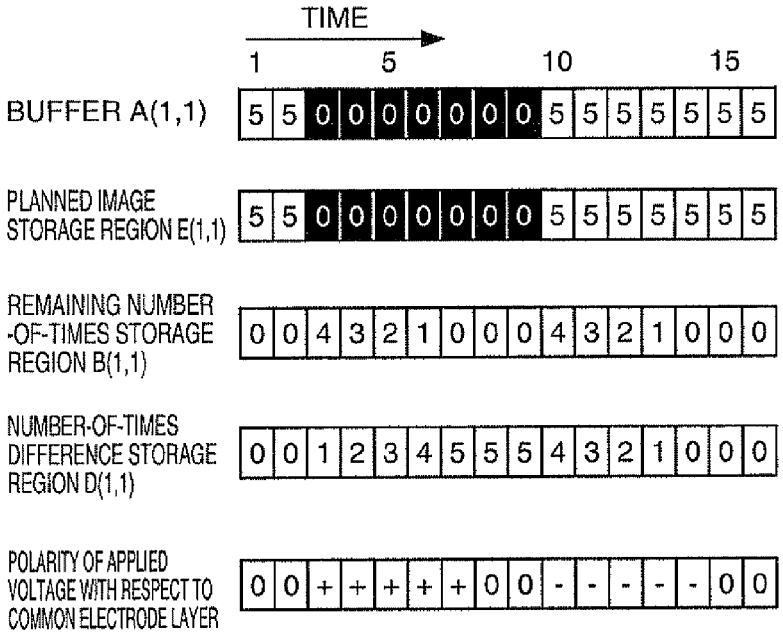
FIG. 17 is a view for explaining an operation in the second embodiment.

Next, an operation of the second embodiment will be described. FIG. 17 is a view showing the content of each storage region changing with time. FIG. 17 shows the content of a buffer A(1, 1), a remaining number-of-times storage region B(1, 1), a number-of-times difference storage region D(1, 1), and a planned image storage region E(1, 1) corresponding to one pixel P(1, 1). In addition, the content of each storage region is a value after a frame period ends. In addition, FIG. 17 also shows the polarity of a voltage, which is applied to the pixel electrode 101*d* in one frame period, with respect to the common electrode layer 103*b*.

First, when the buffer A(1, 1) is rewritten from 5 to 0 before the start of the third frame, the controller 5 performs the processing shown in FIG. 14 before the start of the frame period. Here, when the pixel P(1, 1) is focused, the controller 5 writes 5 in the remaining number-of-times storage region B(1, 1) in step SA5, and writes 0 in the planned image storage region E(1, 1), Thus, the present embodiment is different from the first embodiment in that 5 is written without using the table shown in FIG. 6.

In the third to seventh frames, the controller 5 applies a voltage of +15 V with the voltage Vcom as a reference to the pixel electrode 101*d* of the pixel P(1, 1), and decrements the value of the remaining number-of-times storage region B(1, 1) and increments the value of the number-of-times difference storage region D(1, 1).

In the eighth and ninth frames, the value of the buffer A(1, 1) and the value of the planned image storage region E(1, 1) are the same and the value of the remaining number-of-times storage region B(1, 1) is 0. Accordingly, the controller 5 sets the voltage of the pixel electrode 101*d* of the pixel P(1, 1) to be the same as the voltage Vcom.

When the buffer A(1 , 1) is rewritten from 5 to 0 before the start of the tenth frame, the controller 5 writes 5 in the remaining number-of-times storage region B(1, 1) in step SA5, and writes 5 in the planned image storage region E(1, 1). In the tenth to fourteenth frames, the controller 5 applies a voltage of −15 V with the voltage Vcom as a reference to the pixel electrode 101*d* of the pixel P(1, 1), and decrements the value of the remaining number-of-times storage region B(1, 1) and decrements the value of the number-of-times difference storage region D(1, 1).

Second Operation Example of the Second Embodiment

Figure 18:
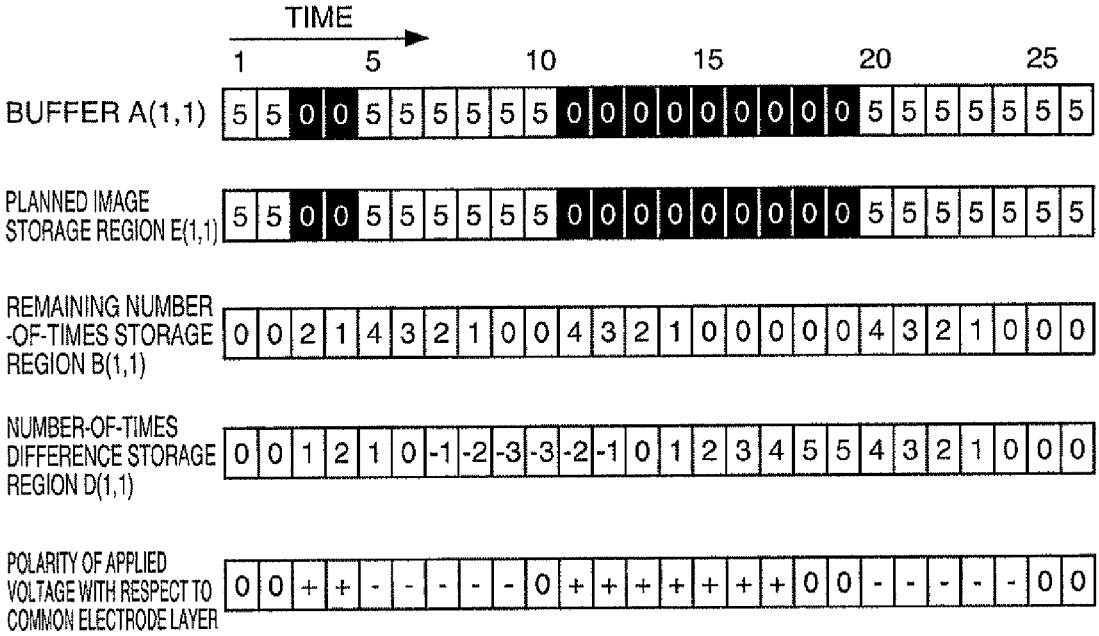
FIG. 18 is a view for explaining an operation in the second embodiment.

Next, an operation when the content of the VRAM 3 is changed before the value of the remaining number-of-times storage region becomes 0 will be described with reference to FIG. 18. FIG. 18 is also a view showing the content of each storage region corresponding to the pixel P(1, 1). In addition, since the operation in first to fourth frames in FIG. 18 is the same as the operation in the first to fourth frames in FIG. 18, explanation thereof will be omitted.

When the buffer A(1, 1) is rewritten from 0 to 5 before the start of the fifth frame, the controller 5 performs the processing shown in FIG. 14 before the start of the frame period. Here, when the pixel P(1, 1) is focused, the controller 5 writes 5 in the remaining number-of-times storage region B(1, 1) in step SA5, and writes 5 in the planned image storage region E(1, 1).

Before the value of the remaining number-of-times storage region B(1, 1) regarding the pixel P(1, 1) becomes 0, the controller 5 determines NO in step SA3 and determines NO in step SA4 if 5 (white) is written in the buffer A(1, 1) as the gray level value of the pixel 110 before the fifth frame. In addition, since the value of the buffer A(1, 1) is 5 (YES in step SA7) and the value of the number-of-times difference storage region D(1, 1) is 2, the controller 5 writes 5 in the remaining number-of-times storage region B(1, 1) in step SA5, and writes 5 in the planned image storage region E(1, 1) in step SA6.

Then, in the fifth to ninth frames, the controller 5 sets the voltage of the pixel electrode 101*d* of the pixel P(1, 1) to −15 V with the voltage Vcom as a reference. When the value of the remaining number-of-times storage region B(I,1) becomes 0 (tenth frame), the controller 5 sets the voltage of the pixel electrode 101*d* of the pixel P(1, 1) to the same voltage as the voltage Vcom.

Then, when 0 (black) is written in the buffer A(1, 1) as the gray level value of the pixel 110 before the eleventh frame, the controller 5 sets the voltage of the pixel electrode 101*d* of the pixel P(1, 1) to +15 V with the voltage Vcom as a reference until the value of the remaining number-of-times storage region B(i, j) becomes 0. Then, the controller 5 sets the voltage of the pixel electrode 101*d* of the pixel P(1, 1) to +15 V with the voltage Vcom as a reference until the value of the number-of-times difference storage region D(i, j) becomes 5. Then, when 5 (white) is written in the buffer A(1, 1) as the gray level value of the pixel 110 before the twentieth frame, the controller 5 sets the voltage of the pixel electrode 101*d* of the pixel P(1, 1) to −15 V with the voltage Vcom as a reference until the value of the remaining number-of-times storage region B(1, 1) becomes 0, in the same manner as in the frames from the tenth frame shown in FIG. 17.

Third Operation Example of the Second Embodiment

Figure 19:
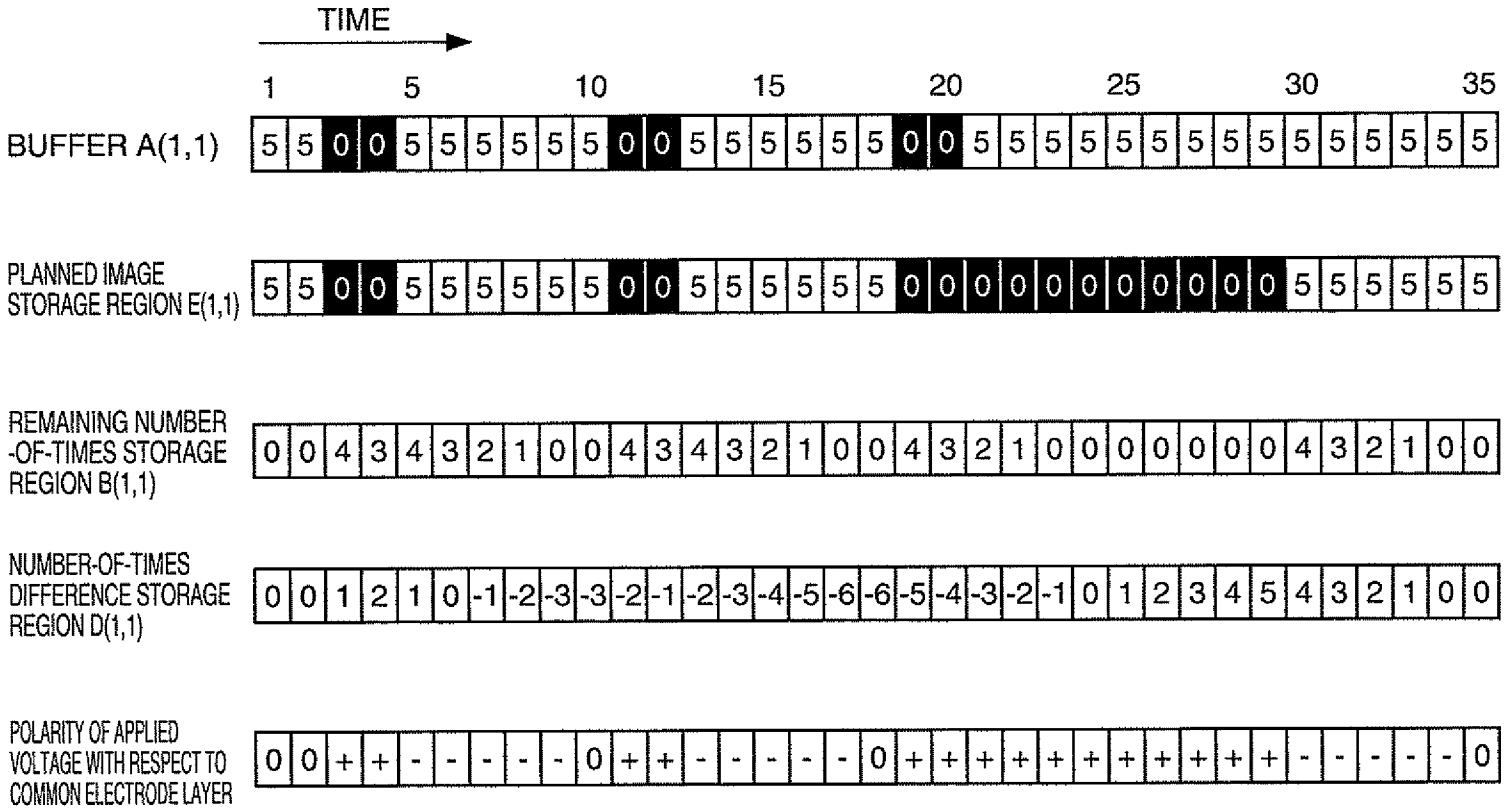
FIG. 19 is a view for explaining an operation in the second embodiment.

Next, a case where the operation of changing the content of the buffer A(1, 1) is repeated before the value of the remaining number-of-times storage region B(1, 1) becomes 0 will be described with reference to FIG. 19. FIG. 19 is also a view showing the content of each storage region corresponding to the pixel P(1, 1). In addition, since the operation in first to twelfth frames in FIG. 19 is the same as the operation in the first to twelfth frames in FIG. 18, explanation thereof will be omitted.

When 5 (white) is written in the buffer A(1, 1) as the gray level value of the pixel 110 before the thirteenth frame, the controller 5 performs the same operation as in the fifth to ninth frame for frames from the thirteenth frame. In addition, when 0 (black) is written in the buffer A(1, 1) as the gray level value of the pixel 110 before the nineteenth frame, the controller 5 performs the same operation as in the third and fourth frames for the nineteenth and twentieth frames.

Then, when 5 (white) is written in the buffer A(1, 1) as the gray level value of the pixel 110 before the twenty-first frame, the controller 5 determines NO in step SA3 and determines NO in step SA4. In addition, since the value of the buffer A(1, 1) is 5 (YES in step SA7), the controller 5 determines the value of the number-of-times difference storage region D(1, 1). In this case, since the value of the number-of-times difference storage region D(1, 1) is −4, the controller 5 determines YES in step SA8 and does not update the content of the planned image storage region E(1, 1).

Then, in a subsequent frame period, the controller 5 performs processing in step SB5 since the value of the buffer A(1, 1) is 5. First, since the value of the buffer A(1, 1) is different from the value of the planned image storage region E(i,j) (NO in step SD1), the controller 5 sets the data line 114 on the first column to +15 V with the voltage Vcom as a reference (step SD2) and then increments the value of the number-of-times difference storage region D(1, 1) to set it to −3. Then, the controller 5 determines whether or not the value of the number-of-times difference storage region D(1, 1) is 5. In this case, since the value of the number-of-times difference storage region D(1, 1) is −3, the controller 3 determines NO in step SD5 and the value of the planned image storage region E(1, 1) is held as 0 as it is.

Then, when the scanning line 112 on the first row is driven (step SB7), a voltage of +15 V with the voltage Vcom as a reference is applied to the pixel electrode 101*d* of the pixel on the first row and the first column, such that black electrophoretic particles move toward the common electrode layer 103*b* even though the value of the buffer A(1, 1) is 5 indicating the white as the gray level of a pixel.

In the twenty-second to twenty-eighth frames, the controller 5 performs the same operation as in the twenty-first frame for the pixel P(1, 1). In the twenty-ninth frame, the value of the buffer A(1, 1) is different from the value of the planned image storage region E(1, 1) (NO in step SD1). Accordingly, the controller 5 sets the data line 114 on the first column to +15 V with the voltage Vcom as a reference (step SD2) and then increments the value of the number-of-times difference storage region D(1, 1) to set it to 5. Then, since the value of the number-of-times difference storage region D(1, 1) is 5 (NO in step SD5), the controller 5 overwrites the value of the planned image storage region E(1, 1) with 5 which is a value of the buffer A(1, 1), and writes 5 in the remaining number-of-times storage region B(1, 1).

In the thirtieth frame, the controller 5 performs processing in step SB5 since the value of the buffer A(1, 1) is 5. Since the value of the buffer A(1, 1) and the value of the planned image storage region E(1, 1) are the same and the value of the remaining number-of-times storage region B(1, 1) is not 0, the controller 5 performs processing in steps SD8 to SD10. That is, a voltage of −15 V with the voltage Vcom as a reference is applied to the pixel electrode 101*d* on the first row and the first column. Then, until the thirty-fourth frame, the controller 5 applies a voltage of −15 V with the voltage Vcom as a reference to the pixel electrode 101*d* of the pixel P(1, 1).

Fourth Operation Example of the Second Embodiment

Figures 20, 21:
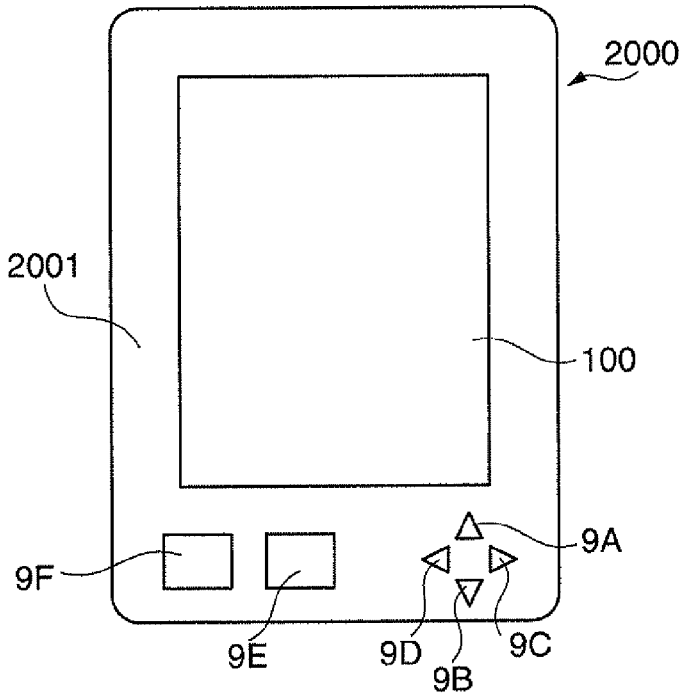
FIG. 20 is a view for explaining an operation in the second embodiment.
FIG. 21 is a view showing the appearance of an electronic book reader.

Next, a case where the operation of changing the content of the buffer A(1, 1) is repeated before the value of the remaining number-of-times storage region B(1, 1) becomes 0 will be described with reference to FIG. 20. FIG. 20 is also a view showing the content of each storage region corresponding to the pixel P(1, 1).

First, in the first frame shown in FIG. 20, the buffer A(1, 1) is 0, the gray level value storage region C(1, 1) is 0, and the remaining number-of-times storage region B(1, 1) and the number-of-times difference storage region D(1, 1) are 5. Here, until the third frame starts, the voltage applied to the pixel electrode 101*d* is the same as the voltage Vcom, and the value of each storage region does not change.

Then, when the buffer A(1, 1) is rewritten from 0 to 5 before the start of the third frame and the value of the buffer A(1, 1) is different from the value (0) of the planned image storage region E(1, 1) before the start of the third frame (NO in step SA3), the controller 5 determines whether or not the remaining number-of-times storage region B(1, 1) is 0. When the remaining number-of-times storage region B(1, 1) is 0 at the time before the start of the third frame as shown in FIG. 20 (YES in step SA4), the controller 5 writes 5, as the number of times of voltage application required to change the gray level of the pixel P(1, 1) from 0 to 5, in the remaining number-of-times storage region B(1, 1) (step SA5). Then, the controller 5 overwrites the value of the planned image storage region E(i, j) with 5 which is a value of the buffer A(i, j) (step SA6).

In a subsequent frame period, the controller 5 drives the scanning line driving circuit 130 and the data line driving circuit 140. Since the value of the buffer A(1, 1) is 5 (NO in step SB3), the value of the buffer A(1, 1) is the same as the value of the planned image storage region E(1, 1) (YES in step SD1), and the value of the remaining number-of-times storage region B(1, 1) is 5 (NO in step SD7), the controller 5 decrements the value of the remaining number-of-times storage region B(1, 1) to set it to 4 (step SD8). The controller 5 sets the data line 114 on the first column to −15 V with the voltage Vcom as a reference (step SD9), and then decrements the value of the number-of-times difference storage region D(1, 1) to set it to 4 (step SD10).

Before the value of the remaining number-of-times storage region B(1, 1) regarding the pixel P(1, 1) becomes 0, the controller 5 determines NO in step SA3 and determines NO in step SA4 if 0 (black) is written in the buffer A(1, 1) as the gray level value of the pixel 110 before the fifth frame. In addition, since the value of the buffer A(1, 1) is 0 (NO in step SA7) and the value of the number-of-times difference storage region D(1, 1) is 3, the controller 5 writes 5 in the remaining number-of-times storage region B(1, 1) in step SA5, and writes 0 in the planned image storage region E(1, 1) in step SA6.

Then, in the fifth to ninth frames, the controller 5 sets the voltage of the pixel electrode 101*d* of the pixel P(1, 1) to +15 V with the voltage Vcom as a reference. When the value of the remaining number-of-times storage region B(1, 1) becomes 0, the controller 5 sets the voltage of the pixel electrode 101*d* of the pixel P(1, 1) to the same voltage as the voltage Vcom.

Then, when 5 (white) is written in the buffer A(1, 1) as the gray level value of the pixel 110 before the eleventh frame, the controller 5 sets the voltage of the pixel electrode 101*d* of the pixel P(1, 1) to −15 V with the voltage Vcom as a reference in the eleventh and twelfth frames, in the same manner as in the third and fourth frames.

Then, when 0 (black) is written in the buffer A(1, 1) as the gray level value of the pixel 110 before the thirteenth frame, the controller 5 determines NO in step SA3 and determines NO in step SA4. In addition, since the value of the buffer A(1, 1) is 0 (NO in step SA7), the controller 5 determines the value of the number-of-times difference storage region D(1, 1). In this case, since the value of the number-of-times difference storage region D(1, 1) is 7, the controller 5 determines YES in step SA11 and does not update the content of the planned image storage region E(1, 1).

Then, in a subsequent frame period, the controller 5 performs processing in step SB4 since the value of the buffer A(i, j) is 0. First, since the value of the buffer A(i, j) is different from the value of the planned image storage region E(i, j) (NO in step SE1), the controller 5 sets the data line 114 on the first column to −15 V with the voltage Vcom as a reference (step SE2) and then decrements the value of the number-of-times difference storage region D(i, j) to set it to 6. Then, the controller 5 determines whether or not the value of the number-of-times difference storage region D(1, 1) is 0. In this case, since the value of the number-of-times difference storage region D(1, 1) is 6, the controller 6 determines NO in step SE4 and the value of the planned image storage region E(1, 1) is held as 5 as it is.

Then, when the scanning line 112 on the first row is driven (step SB7), a voltage of −15 V with the voltage Vcom as a reference is applied to the pixel electrode 101*d* of the pixel on the first row and the first column, such that white electrophoretic particles move toward the common electrode layer 103*b* even though the value of the buffer A(1, 1) is 0 indicating the black as the gray level of a pixel.

Then, until the nineteenth frame in which the value of the number-of-times difference storage region D(i, j) becomes 0, a voltage of −15 V with the voltage Vcom as a reference is applied to the pixel P(1, 1). In the nineteenth frame, the controller 5 determines YES in step SE4, and writes 5 in the remaining number-of-times storage region B(i, j), and overwrites the value of the planned image storage region E(i, j) with the value of the buffer A(i, j).

In the twentieth frame, the controller 5 performs processing in step SB4 since the value of the buffer A(1, 1) is 0. Since the value of the buffer A(1, 1) and the value of the planned image storage region E(1, 1) are the same and the value of the remaining number-of-times storage region B(1, 1) is not 0, the controller 5 performs processing in steps SE7 to SE9. That is, a voltage of +15 V with the voltage Vcom as a reference is applied to the pixel electrode 101*d* on the first row and the first column. Then, until the twenty-fourth frame, the controller 5 applies a voltage of +15 V with the voltage Vcom as a reference to the pixel electrode 101*d* of the pixel P(1, 1).

Thus, even if an operation for rewriting to white is repeated while a pixel is being rewritten in black, the voltage applied to the pixel electrode 101*d* is controlled. Accordingly, a large difference does not occur between the number of times of application of a positive voltage with the common electrode layer 103*b* as a reference and the number of times of application of a negative voltage with the common electrode layer 103*b* as a reference. As a result, it is possible to suppress deterioration of the pixel 110.

Electronic Apparatus

Next, an example of an electronic apparatus to which the electro-optical device 1 according to the embodiment is applied will be described. FIG. 21 is a view showing the appearance of an electronic book reader using the electro-optical device 1. An electronic book reader 2000 includes a plate shaped frame 2001, buttons 9A to 9F, the electro-optical device 1 according to the above-described embodiment, the control unit 2, the VRAM 3, and the RAM 4. In the electronic book reader 2000, the display area 100 is exposed. In the electronic book reader 2000, the content of electronic book is displayed in the display area 100, and the page of the electronic book is turned over by operating the buttons 9A to 9F.

In addition to this, examples of an electronic apparatus to which the electro-optical device 1 according to the embodiment described above can be applied may include a timepiece, electronic paper, an electronic diary, a calculator, a mobile phone, and the like.

MODIFICATION EXAMPLES

While the embodiments of the invention have been described, the invention is not limited to the above embodiments and various modifications may also be made. For example, the invention may also be performed by modifying the above-described embodiments as follows. In addition, the above-described embodiments and the following modification examples may be combined.

In the invention, the number of times of voltage application when rewriting a pixel may be changed according to the temperature around the pixel 110. For example, the number of times of voltage application maybe reduced when the temperature is high, and the number of times of voltage application may be increased when the temperature is low. In addition, when the number of times of voltage application when rewriting a pixel is changed according to the temperature, the value used in determination processing of steps SA8, SC6, and SD5 and the like in the first embodiment may be changed according to the temperature. In addition, when the number of times of voltage application when rewriting a pixel is changed according to the temperature, the value used in determination processing of steps SA8, SA11, SE4, and SD5 and the like in the second embodiment may be changed according to the temperature.

In the invention, a case where the number of times of voltage application from white to black is larger than the number of times of voltage application from black to white (for example, the number of times of voltage application from black to white is 3, and the number of times of voltage application from white to black is 5) may occur depending on the material of electrophoretic particles.

In this case, in the first embodiment, processing shown in FIGS. 22 to 25 is performed instead of the processing shown in FIGS. 7 to 10.

Figure 22:
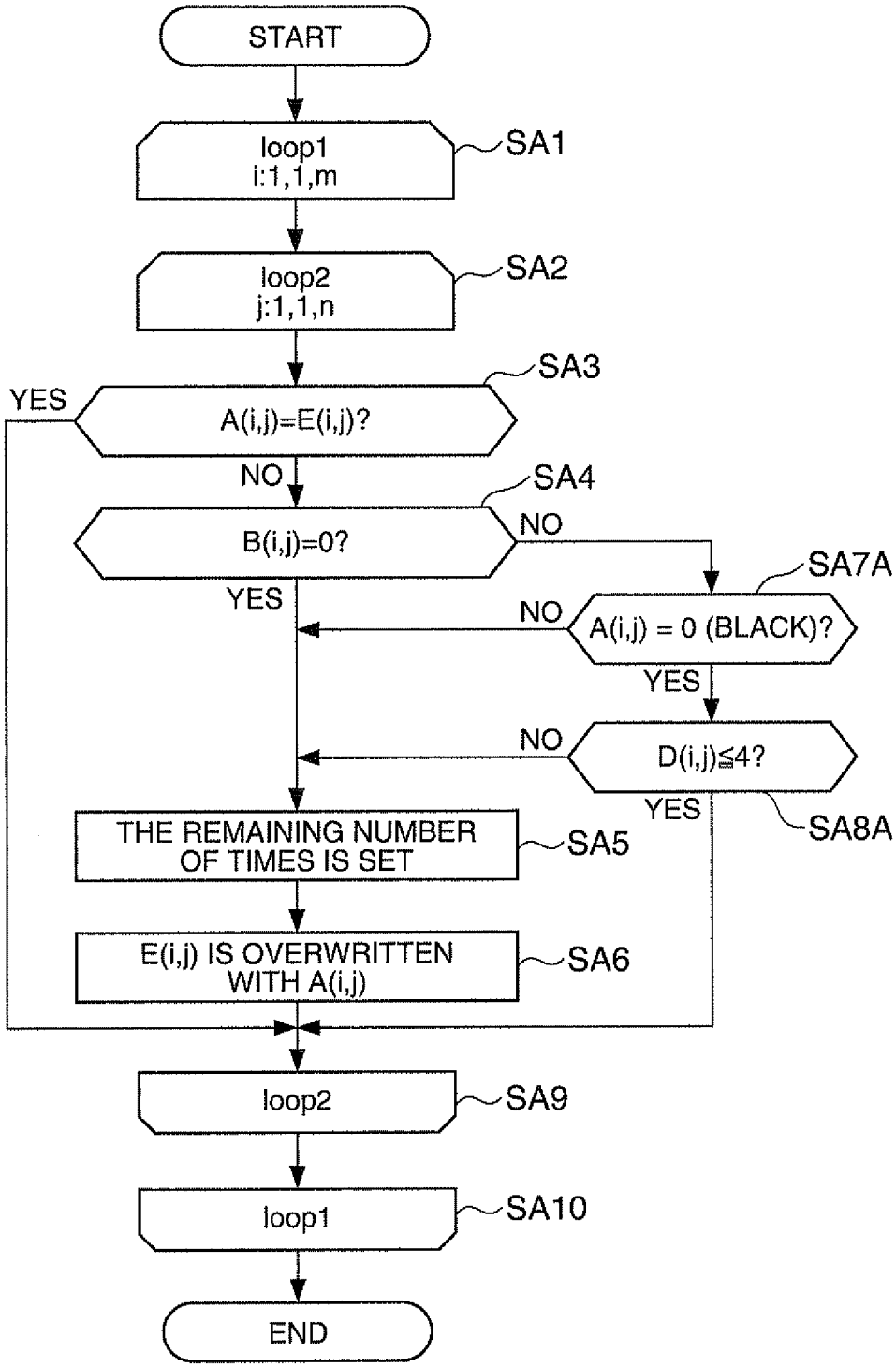
FIG. 22 is a flow chart showing the flow of processing performed by a controller in a modification example.

In processing shown in FIG. 22, the process proceeds to step SA5 if the value of the buffer A(i, j) is 5 (white) in step SA7A, and the process proceeds to step SA8A if the value is 0 (black). Then, in step SA8A, the process proceeds to step SA9 if the value of the number-of-times difference storage region D(i, j) is equal to or larger than 4, and the process proceeds to step SA5 if the value of the number-of-times difference storage region D(i, j) is smaller than 4.

Figure 23:
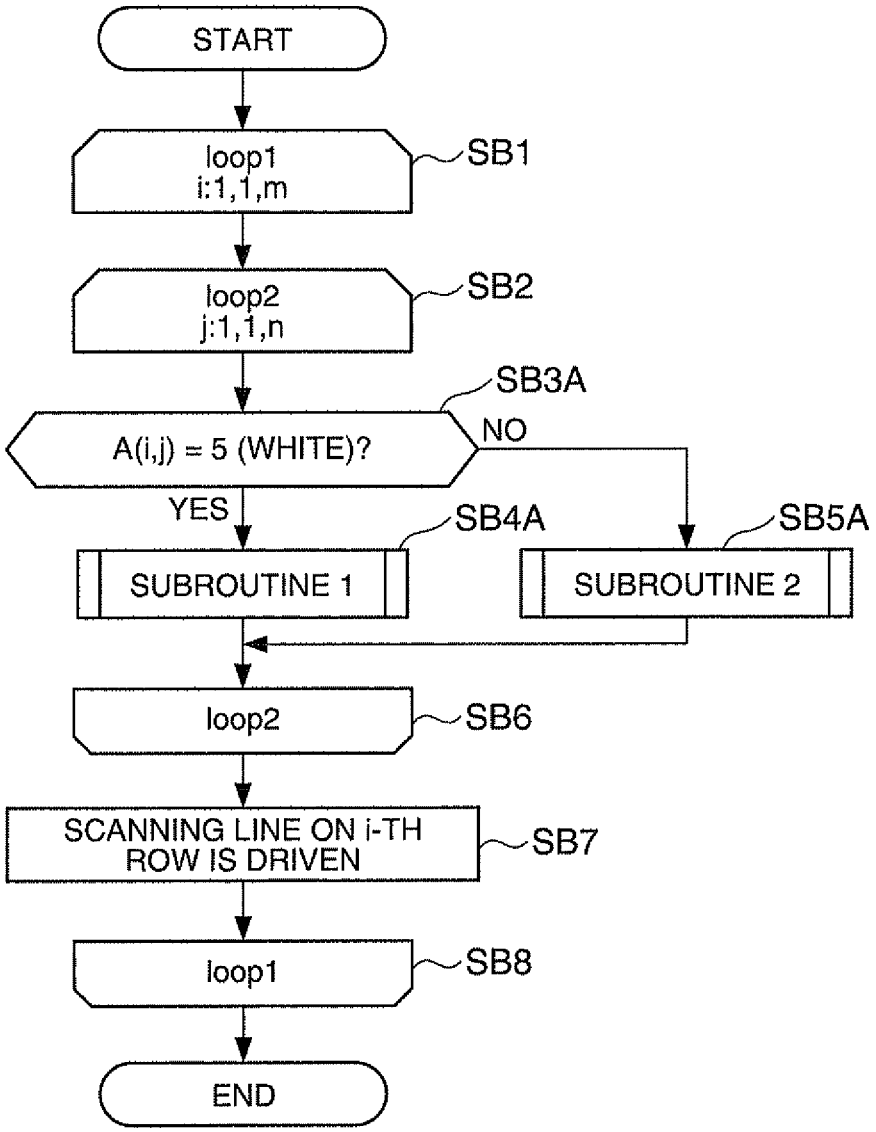
FIG. 23 is a flow chart showing the flow of processing performed by the controller in the modification example.
Figure 24:
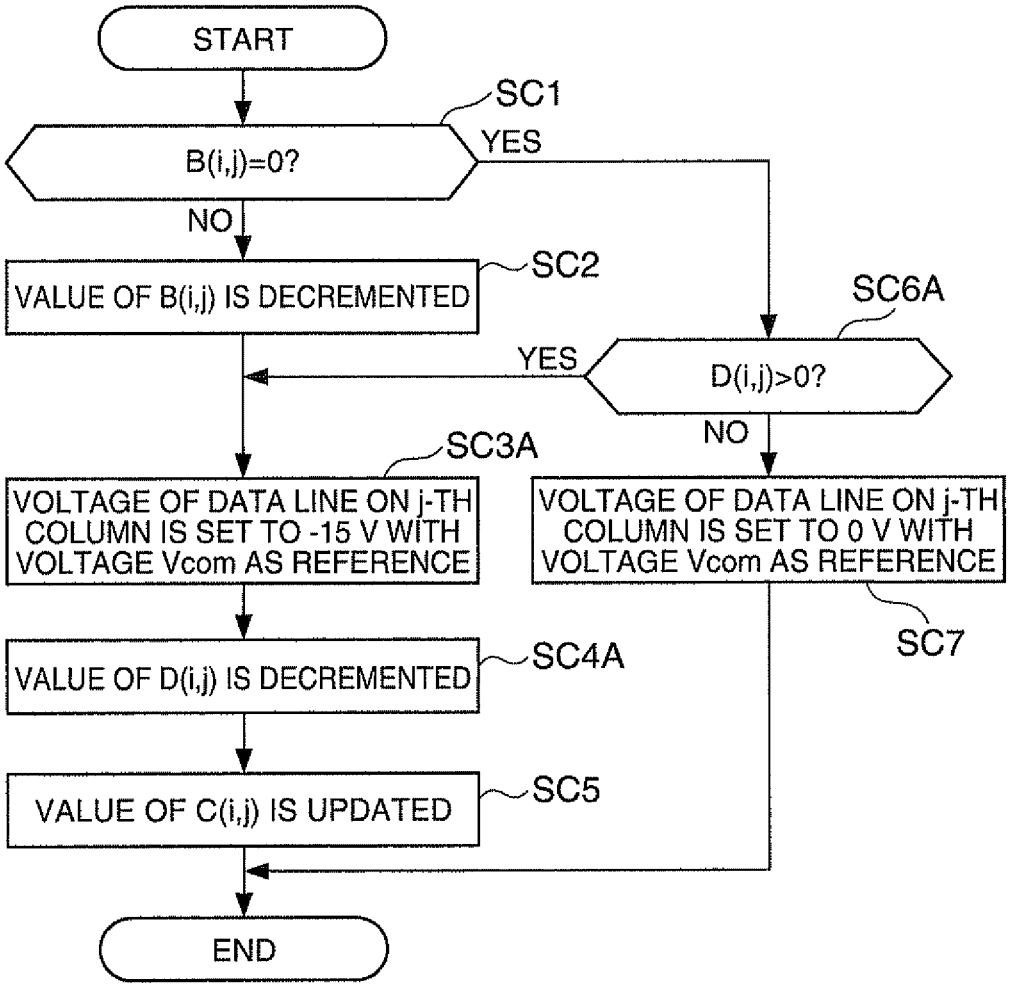
FIG. 24 is a flow chart showing the flow of processing performed by the controller in the modification example.
Figure 25:
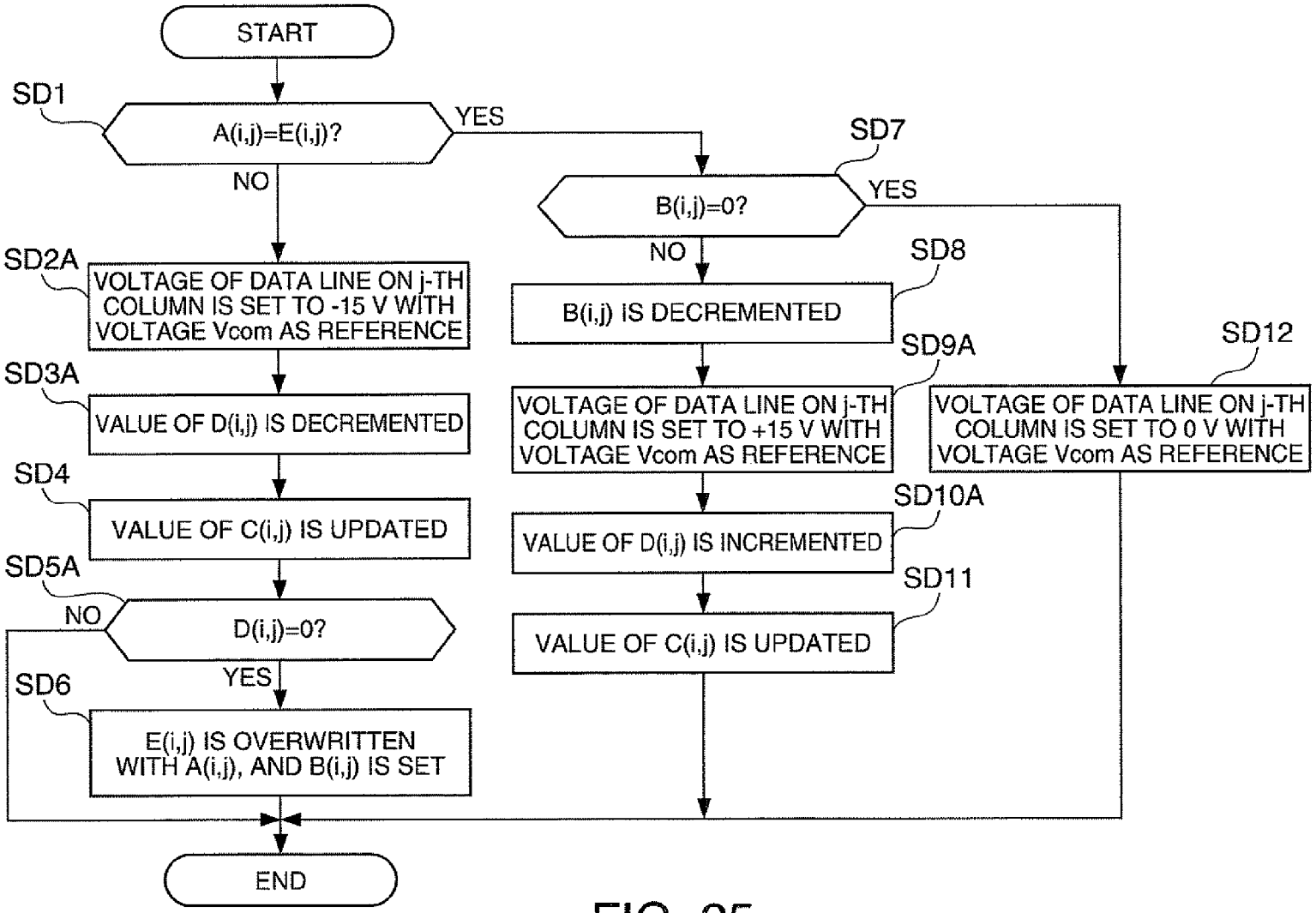
FIG. 25 is a flow chart showing the flow of processing performed by the controller in the modification example.

In addition, in processing shown in FIG. 23, the process proceeds to step SB4A if the value of the buffer A(i, j) is 5 (white) in step SB3A, and the process proceeds to step SB5A if the value is 0 (black). In addition, processing shown in FIG. 24 is performed in step SB4A, and processing shown in FIG. 25 is performed in step SB5A. Moreover, in the processing shown in FIG. 24, the data line on the j-th column is set to −15 V with the voltage Vcom as a reference in step SC3A, and the value of the number-of-times difference storage region D(i, j) is decremented in step SC4A.

Then, in the processing shown in FIG. 24, it is determined whether or not the value of the number-of-times difference storage region D(i, j) is larger than 0 in step SC6A. The process proceeds to step SC3A if the value of the number-of-times difference storage region D(i, j) is larger than 0, and the processing shown in FIG. 24 is ended if the value of the number-of-times difference storage region D(i, j) is equal to or smaller than 0.

Moreover, in the processing shown in FIG. 25, the data line on the j-th column is set to −15 V with the voltage Vcom as a reference in step SD2A, and the value of the number-of-times difference storage region D(i, j) is decremented in step SD3A. If the value of the number-of-times difference storage region D(i, j) is 0 in step SD5A, the process proceeds to step SD6. If the value is 5, the processing shown in FIG. 25 is ended. Moreover, in the processing shown in FIG. 25, the data line on the j-th column is set to +15 V with the voltage Vcom as a reference in step SD9A, and the value of the number-of-times difference storage region D(i, j) is incremented in step SD10A.

According to this configuration, even if an operation for rewriting to black is repeated while a pixel is being rewritten in white, the voltage applied to the pixel electrode 101*d* is controlled. Accordingly, a large difference does not occur between the number of times of application of a positive voltage with the common electrode layer 103*b* as a reference and the number of times of application of a negative voltage with the common electrode layer 103*b* as a reference. As a result, it is possible to suppress deterioration of the pixel 110.

In the embodiment described above, the electro-optical device including the electrophoretic layer 102 has been described as an example. However, the invention is not limited to this. Any electro-optical device may be used as long as the writing for changing the display state of a pixel from the first display state to the second display state is performed by a writing operation in which a voltage is applied multiple times. For example, it is also possible to use an electro-optical device using the electronic liquid powder.

The entire disclosure of Japanese Patent Application No: 2011-132463, filed Jun. 14, 2011, and US Provisional Application No. 61/484424, filed May 10, 2011 are expressly incorporated by reference herein.

What is claimed is:

1. A controller of an electro-optical device which includes a display unit with a plurality of pixels and in which a writing operation of changing the pixel from first gray level to second gray level and a writing operation of changing the pixel from the second gray level to the first gray level are performed by an operation of applying a voltage to the pixel multiple times, the controller comprising:

a number-of-times difference calculating section that calculates a difference between the number of times of application of a first voltage, which is applied to change the pixel to the first gray level, and the number of times of application of a second voltage, which is applied to change the pixel to the second gray level; and a voltage control section that applies the first voltage or the second voltage to the pixel until the difference becomes a predetermined value when the difference regarding the pixel is not the predetermined value at a predetermined timing and that, when changing a gray level of the pixel, starts a new operation of applying a voltage to the pixel multiple times even in the middle of the writing operation.

2. The controller of an electro-optical device according to claim 1, wherein when the pixel has the first gray level and the difference regarding the pixel is not the predetermined value after the writing operation ends, the voltage control section applies the first voltage to the pixel until the difference becomes the predetermined value.

3. The controller of an electro-optical device according to claim 1, wherein when the pixel has the second gray level and the difference regarding the pixel is not the predetermined value after the writing operation ends, the voltage control section applies the second voltage to the pixel until the difference becomes the predetermined value.

4. The controller of an electro-optical device according to claim 1, wherein when an absolute value of the difference is equal to or larger than a threshold value when a writing operation of setting the pixel to the first gray level starts in the middle of a writing operation of setting the pixel to the second gray level, the voltage control section applies the second voltage until the difference becomes the predetermined value and then starts application of the first voltage.

5. The controller of an electro-optical device according to claim 1, wherein when an absolute value of the difference is equal to or larger than a threshold value when a writing operation of setting the pixel to the second gray level starts in the middle of a writing operation of setting the pixel to the first gray level, the voltage control section applies the first voltage until the difference becomes the predetermined value and then starts application of the second voltage.

6. The controller of an electro-optical device according to claim 1, further comprising:

an application number-of-times determining section that, when changing the gray level of the pixel, determines the number of times of application on the basis of the gray level of the pixel before the change, the gray level of the pixel after the change, and a table in which the number of times of application of a voltage for gray level change from the gray level before the change to the gray level after the change matches the gray level before the change and the gray level after the change.

7. The controller of an electro-optical device according to claim 1, wherein the number of times of application of the first voltage applied to change the pixel to the first gray level is different from the number of times of application of the second voltage applied to change the pixel to the second gray level.

8. A control method of an electro-optical device which includes a display unit with a plurality of pixels and in which a writing operation of changing the pixel from first gray level to second gray level and a writing operation of changing the pixel from the second gray level to the first gray level are performed by an operation of applying a voltage to the pixel multiple times, the control method comprising:

calculating a difference between the number of times of application of a first voltage, which is applied to change the pixel to the first gray level, and the number of times of application of a second voltage, which is applied to change the pixel to the second gray level; and applying the first voltage or the second voltage to the pixel until the difference becomes a predetermined value when the difference regarding the pixel is not the predetermined value at a predetermined timing and starting a new operation of applying a voltage to the pixel multiple times even in the middle of the writing operation when changing a gray level of the pixel.

9. An electro-optical device which includes a display unit with a plurality of pixels and in which a writing operation of changing the pixel from first gray level to second gray level and a writing operation of changing the pixel from the second gray level to the first gray level are performed by an operation of applying a voltage to the pixel multiple times, the electro-optical device comprising:

a number-of-times difference calculating section that calculates a difference between the number of times of application of a first voltage, which is applied to change the pixel to the first gray level, and the number of times of application of a second voltage, which is applied to change the pixel to the second gray level; and a voltage control section that applies the first voltage or the second voltage to the pixel until the difference becomes a predetermined value when the difference regarding the pixel is not the predetermined value at a predetermined timing and that, when changing a gray level of the pixel, starts a new operation of applying a voltage to the pixel multiple times even in the middle of the writing operation.

10. An electronic apparatus comprising the electro-optical device according to claim 9.

11. The controller of an electro-optical device according to claim 1, further comprising:

a buffer storage region, wherein the voltage control section controls the voltage applied to the pixel even if values in the buffer storage region are rewritten.

12. The controller of an electro-optical device according to claim 1, wherein the first voltage is a positive voltage and the second voltage is a negative voltage, and the voltage control section applies the first voltage or the second voltage to the pixel to not exceed a difference between a number of times of application of the first voltage and a number of times of application of the second voltage.

13. The controller of an electro-optical device according to claim 1, wherein a number of times a negative voltage is applied to the pixel to change the pixel from a state where the pixel is black to a state where the pixel is white is different than the number of times a positive voltage is applied to the pixel to change the pixel from a state where the pixel is white to a state where the pixel is black.

14. The controller of an electro-optical device according to claim 1, further comprising:

a remaining number-of-times storage region, wherein the number-of-times difference calculating section writes to the remaining number-of-times storage region a number of times of voltage application to change the gray level of the pixel from a state where the pixel is black to a state wherein the pixel is white or from a state where the pixel is white to a state where the pixel is black, the number-of-times difference calculating section writing updated values to the remaining number-of-times storage region upon application of a voltage to the pixel and overwriting a value in a planned image storage region with a value stored in an image buffer.

* * * * *